US010683993B2

(12) United States Patent
Green et al.

(10) Patent No.: US 10,683,993 B2
(45) Date of Patent: Jun. 16, 2020

(54) PERIPHERY-LIT TROFFER LIGHT FIXTURE RETROFIT SYSTEMS AND METHODS

(71) Applicant: Orion Energy Systems, Inc., Manitowoc, WI (US)

(72) Inventors: Scott A. Green, Ponte Verda Beach, FL (US); Joe Bluma, Manitowoc, WI (US); Matthew S. Tlachac, Manitowoc, WI (US); Paul Stegemann, Manitowoc, WI (US); John Scribante, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 196 days.

(21) Appl. No.: 15/996,314

(22) Filed: Jun. 1, 2018

(65) Prior Publication Data

US 2018/0274761 A1 Sep. 27, 2018

Related U.S. Application Data

(63) Continuation of application No. 15/345,276, filed on Nov. 7, 2016, now Pat. No. 10,174,915, which is a (Continued)

(51) Int. Cl.
*F21V 21/02* (2006.01)
*F21S 8/02* (2006.01)
(Continued)

(52) U.S. Cl.
CPC ..... *F21V 21/02* (2013.01); *F21S 8/026* (2013.01); *F21S 8/04* (2013.01); *F21V 5/04* (2013.01); *F21V 7/005* (2013.01); *F21V 13/04* (2013.01); *F21V 15/01* (2013.01); *F21V 21/04* (2013.01); *F21V 23/003* (2013.01); *F21V 23/02* (2013.01); *F21Y 2101/00* (2013.01); *F21Y 2103/00* (2013.01); *F21Y 2113/00* (2013.01); *F21Y 2115/10* (2016.08)

(58) Field of Classification Search
CPC ..... F21V 21/02; F21V 23/003; F21V 23/02; F21V 13/04
See application file for complete search history.

(56) References Cited

U.S. PATENT DOCUMENTS 4,041,657 A 8/1977 Schuplin
6,739,734 B1 5/2004 Hulgan
(Continued)

*Primary Examiner* — Evan P Dzierzynski
(74) *Attorney, Agent, or Firm* — Foley & Lardner LLP

(57) ABSTRACT

A retrofitting kit includes at least one of an adapter bracket and a retainer configured to engage at least one of an existing troffer light fixture and a T-bar of a ceiling system and a door assembly configured to be held in the ceiling system by the at least one of the adapter bracket and the retainer. The door assembly has a housing, the housing including one or more sidewalls, where the one or more sidewalls extend upward to define a cavity, and a plurality of LEDs having primary light axes extending inward into the cavity. The plurality of LEDs are coupled to the one or more sidewalls and positioned to illuminate at least a portion of the housing from behind with a uniform distribution of light when engaged.

20 Claims, 35 Drawing Sheets

Related U.S. Application Data continuation of application No. 14/866,573, filed on Sep. 25, 2015, now Pat. No. 9,488,348.

(60) Provisional application No. 62/056,294, filed on Sep. 26, 2014, provisional application No. 62/056,262, filed on Sep. 26, 2014.

(51) Int. Cl.

| | |
|---|---|
| ***F21V 7/00*** | (2006.01) |
| ***F21V 13/04*** | (2006.01) |
| ***F21V 21/04*** | (2006.01) |
| ***F21S 8/04*** | (2006.01) |
| ***F21V 5/04*** | (2006.01) |
| ***F21V 15/01*** | (2006.01) |
| ***F21V 23/00*** | (2015.01) |
| ***F21V 23/02*** | (2006.01) |
| *F21Y 115/10* | (2016.01) |
| *F21Y 103/00* | (2016.01) |
| *F21Y 113/00* | (2016.01) |
| *F21Y 101/00* | (2016.01) |

(56) References Cited

U.S. PATENT DOCUMENTS

| | | | | |
|---|---|---|---|---|
| 8,083,369 | B1 | 12/2011 | Richardson et al. | |
| 8,523,383 | B1 | 9/2013 | Grigore et al. | |
| 8,764,216 | B2 | 7/2014 | Caferro et al. | |
| 9,206,948 | B1 * | 12/2015 | Scribante | F21K 9/275 |
| 9,322,518 | B1 * | 4/2016 | Steedly | F16B 1/00 |
| 9,797,580 | B2 * | 10/2017 | Quinlan | F21S 8/04 |
| 2005/0013136 | A1 | 1/2005 | Rutchik | |
| 2010/0277934 | A1 | 11/2010 | Oquendo et al. | |
| 2012/0176784 | A1 | 7/2012 | Peifer et al. | |
| 2012/0192486 | A1 | 8/2012 | Shanahan et al. | |
| 2014/0292198 | A1 | 10/2014 | Sanders et al. | |
| 2015/0267873 | A1 | 9/2015 | Price et al. | |
| 2015/0276125 | A1 | 10/2015 | Pratt et al. | |

* cited by examiner

PERIPHERY-LIT TROFFER LIGHT FIXTURE RETROFIT SYSTEMS AND METHODS

CROSS-REFERENCE TO RELATED PATENT APPLICATIONS

This application is a continuation of U.S. patent application Ser. No. 15/345,276, filed Nov. 7, 2016, which is a continuation of U.S. patent application Ser. No. 14/866,573, now U.S. Pat. No. 9,488,348, filed Sep. 25, 2015, which claims the benefit of U.S. Provisional Patent Application Nos. 62/056,262, filed Sep. 26, 2014, and 62/056,294, filed Sep. 26, 2014, all of which are incorporated herein by reference in their entireties.

BACKGROUND

The invention relates generally to a system and method for retrofitting an existing troffer style light fixture. Existing troffer light fixtures can be retrofitted to include a more efficient light source, replace components of a damaged troffer style light fixture, and/or otherwise upgrade or replace an existing troffer light fixture.

A troffer light fixture is a generally square or rectangular tray like housing and light source which is installed in a ceiling system. The ceiling system may be a dropped ceiling, ceiling grid and tile system, or other engineered ceiling system. The troffer light fixture includes a housing which includes a top body wall and four side body walls. Mounted to the troffer housing are typically lamp sockets (e.g., for fluorescent lamps), lighting ballast which receives electrical power from wiring within the ceiling, and/or other components. The troffer light fixture may further include a door which attaches to the troffer housing. The door may be or include a lens and typically opens downward from the troffer housing. It is challenging and difficult to develop a system which allows for quick and easy retrofitting of an existing troffer light fixture. It is also challenging and difficult to develop a system which retrofits an existing troffer light fixture and reuses the existing troffer housing. Further, it is challenging and difficult to develop a system which is compatible with a variety of troffer light fixtures.

SUMMARY

One embodiment relates to a retrofitting kit for retrofitting an existing troffer light fixture having a troffer housing. The retrofitting kit includes at least one of an adapter bracket and a retainer configured to engage at least one of the existing troffer light fixture and a T-bar of a ceiling system and a door assembly configured to be held in the ceiling system by the at least one of the adapter bracket and the retainer. The door assembly has a housing including one or more sidewalls, where the one or more sidewalls extend upward to define a cavity, and a plurality of LEDs having primary light axes extending inward into the cavity. The plurality of LEDs are coupled to the one or more sidewalls and positioned to illuminate at least a portion of the housing from behind with a uniform distribution of light when engaged. The plurality of LEDs are disposed around at least a portion of a periphery of the housing thereby providing a low-profile lighting arrangement configured to fit within a space above the ceiling system.

Another embodiment relates to a light fixture that includes a retainer configured to engage a T-bar of a ceiling system and a door assembly configured to be held in the ceiling system by the retainer. The door assembly has a housing including one or more sidewalls, where the one or more sidewalls extend upward to define a cavity, and a plurality of LEDs having primary light axes extending inward into the cavity. The plurality of LEDs are coupled to the one or more sidewalls and positioned to illuminate at least a portion of the housing from behind with a uniform distribution of light when engaged. The plurality of LEDs are disposed around at least a portion of a periphery of the housing thereby providing a low-profile lighting arrangement configured to fit within a space above the ceiling system.

Another embodiment relates to a method for retrofitting an existing troffer light fixture using a door assembly that includes removing a door of the existing troffer light fixture, disconnecting the wiring from a power source to the existing troffer light fixture, wiring the door assembly to the wiring from the power source, and installing the door assembly within a ceiling system with which the existing troffer light fixture is associated. Installing the door assembly includes inserting a housing of the door assembly through an opening in the ceiling system and thereafter lowering the housing such that a portion of the door assembly engages a T-bar of the ceiling system. The door assembly includes a plurality of LEDs coupled to one or more sidewalls of the housing.

DETAILED DESCRIPTION

Figure 1:
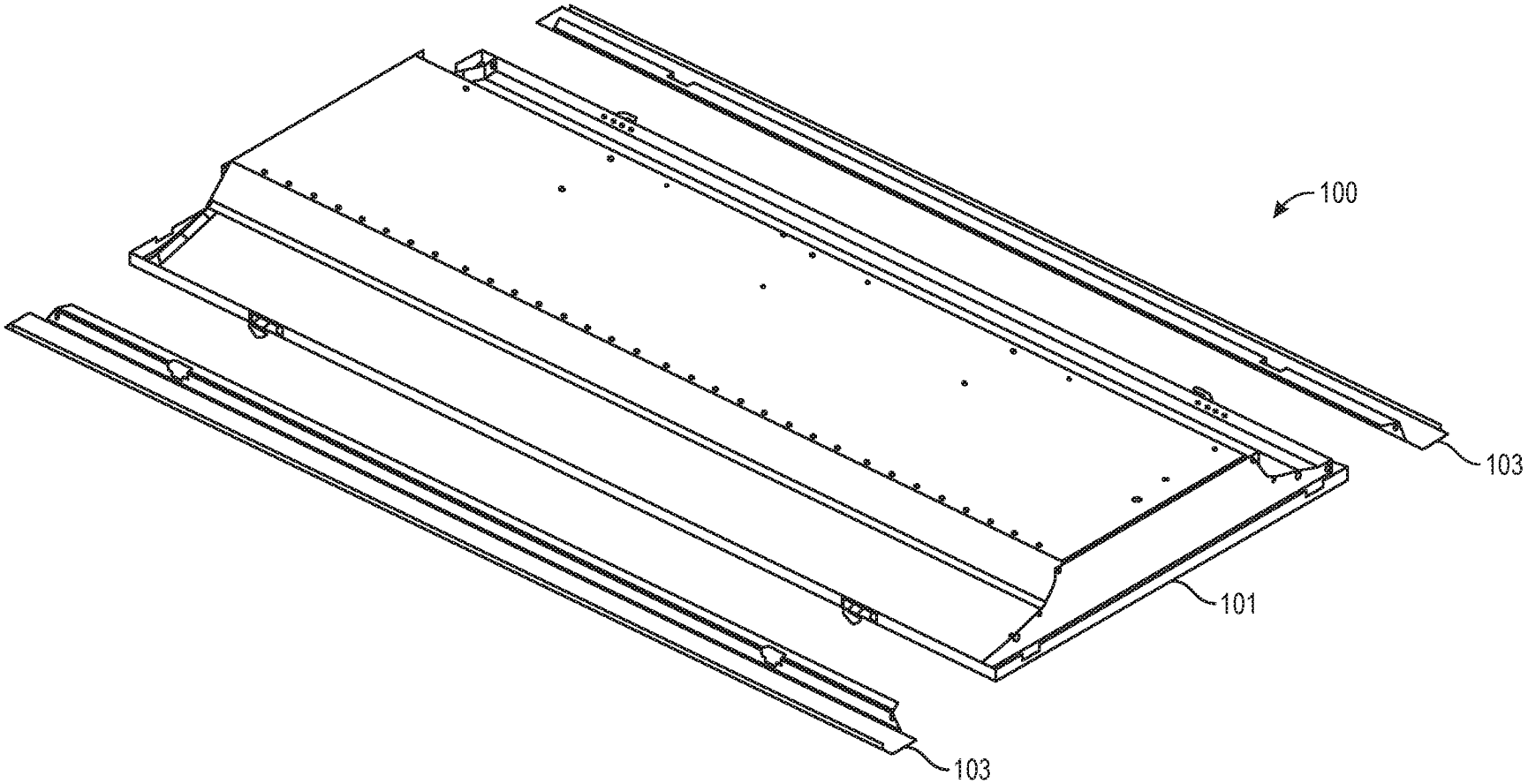
FIG. 1 is an illustration of a troffer retrofit system including a troffer door assembly and two adaptor brackets according to an exemplary embodiment.

In the following detailed description, reference is made to the accompanying drawings. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring now to FIG. 1, troffer door retrofit system 100 is shown according to one embodiment. Troffer door retrofit system 100 includes door assembly 101 and two adaptor brackets 103. Troffer door retrofit system 100 can be used to upgrade, retrofit, replace, and/or install a lighting fixture in an existing troffer housing. Adaptor brackets 103 may held into place in a ceiling system (e.g., a dropped ceiling) using a T-bar of the ceiling system and an existing troffer housing (e.g., the housing of an existing troffer light fixture which is being retrofit). Door assembly 101 can then be hung using hinges and/or latches from slots included in adaptor brackets 103 and wired to an existing wiring system (e.g., the wiring system which was supplying the existing troffer light fixture).

In alternative embodiments, troffer door retrofit system 100 includes only door assembly 101. Door assembly 101 can include hinges and/or latches which are positioned such that door assembly 101 can be hung from an existing troffer housing. For example, an existing troffer light fixture may include a door hung from slots included in the housing of the existing troffer light fixture. The door may be removed, and door assembly 101 of troffer door retrofit system 100 may be hung from the slots in the housing of the existing troffer light fixture. Internal components (e.g., lamps and ballast) of the existing troffer light fixture may be removed first to make room for door assembly 101 when in the closed position.

In further embodiments, troffer door retrofit system 100 includes door assembly 101 and adaptor brackets 103, but adaptor brackets 103 may be optionally used when retrofitting an existing troffer light fixture. For example, the hinges and latches of door assembly 101 may be positioned such that door assembly 101 is compatible with a wide range of and/or a common existing troffer light fixture and its housing. The door of the existing troffer light fixture may be removed and replaced with door assembly 101 (e.g., without the use of adaptor brackets 103). If door assembly 101 is not compatible with an existing troffer housing (e.g., the hinges and or latches do not align with slots in the existing troffer housing), adaptor brackets 103 may be used. This adaptability may advantageously increase the number of existing troffer light fixture types (e.g., different configurations and/or different manufacturers) with which troffer door retrofit system 100 is compatible. Thus, troffer door retrofit system 100 may be packaged or sold with both door assembly 101 and adaptor brackets 103 to increase the number of existing troffer light fixtures which can be retrofit as described herein. In alternative embodiments, door assembly 101 and/or adaptor brackets 103 may be packaged or sold individually.

In some further embodiments, door assembly 101 includes hinges and/or latches which may be repositioned on door assembly 101. For example, the hinges and/or latches may be secured in a slot which allows longitudinal movement, and the hinges and/or latches may be secured in the desirable position by engaging a fastener (e.g., tightening a nut and bolt combination). Advantageously, this may increase the number of existing troffer light fixtures with which troffer door retrofit system 100 is compatible (e.g., door assembly 101 may be compatible with a larger range of slot configurations in existing troffer housings).

Still referring to FIG. 1, door assembly 101 can include one or more lamps which may be more efficient than the lamps in an existing troffer light fixture. For example, door assembly 101 may include light emitting diodes (LEDs) which are more efficient than the lamps of the existing troffer light fixture. The existing troffer light fixture may include lamps of other types such as florescent lamps, incandescent lamps, halogen lamps, and/or less efficient LEDs. Advantageously, troffer door retrofit system 100 may be used to replace the existing troffer light fixture (e.g., in part while retaining the existing housing, wiring, and/or other components) and its less efficient lamps with the more efficient lamps included in door assembly 101. Door assembly 101 may be wired to existing supplies, ballasts, and/or other power systems or electronics (e.g., controllers, automation systems, sensors, etc.) of the existing troffer light fixture. Thus, an existing troffer light fixture may be retrofit using troffer door retrofit system 100 such that the resulting troffer light fixture is more efficient, uses less electricity, gives of less heat, and/or includes other benefits. This may reduce the operating costs of a lighting system including one or more troffer light fixtures (e.g., a lighting system in an office building, warehouse, or home, an outdoor lighting system, and/or any lighting system including troffer light fixtures). While LEDs are specifically used in many of the examples described, other types of lamps or light sources (e.g., fluorescent lamps, halogen lamps, incandescent lamps, organic LEDs, incandescent lamps, discharge lamps, liquid crystal displays, plasma displays, and/or other light sources) may be used in varying embodiments.

Troffer door retrofit system 100 and door assembly 101 may include the same style lamps as an existing troffer light fixture or otherwise be approximately equivalent in parameters such as efficiency, cost to operate, lifespan, operating costs including maintenance, and/or other parameters. However, troffer door assembly 101 may include ballast, a controller, sensors, communication equipment, and/or other electronic components which are superior to those of an existing troffer light fixture or not included in an existing troffer light fixture. Retrofitting an existing troffer light fixture using troffer door retrofit system 100 may therefore provide an upgrade in electronics associated with a lighting system, sensors associated with a lighting system, control of a lighting system, automation of a lighting system, and/or otherwise upgrade a lighting system other than increasing the efficiency of the system by replacing the type of lamp used.

As an additional example, troffer door retrofit system 100 may provide a further advantage by allowing for easy replacement or repair of existing troffer light fixtures. For example, an existing troffer light fixture may break or otherwise need maintenance or repair (e.g., one or more lamps have burnt out or need replacing, ballast has been damaged or stops functioning properly, and/or other components require maintenance or repair). Troffer door retrofit system 100 may be used to replace components rather than repair them. Advantageously, this may be more cost effective than repairing the component (e.g., including or not including the long term energy savings of switching to a more efficient lamp) and may be more cost effective than replacing the entire existing troffer light fixture with one of the same type (e.g., troffer door retrofit system 100 may be comparable on cost and it may be quicker to install troffer door retrofit system 100 thereby reducing labor costs).

Figure 2A:
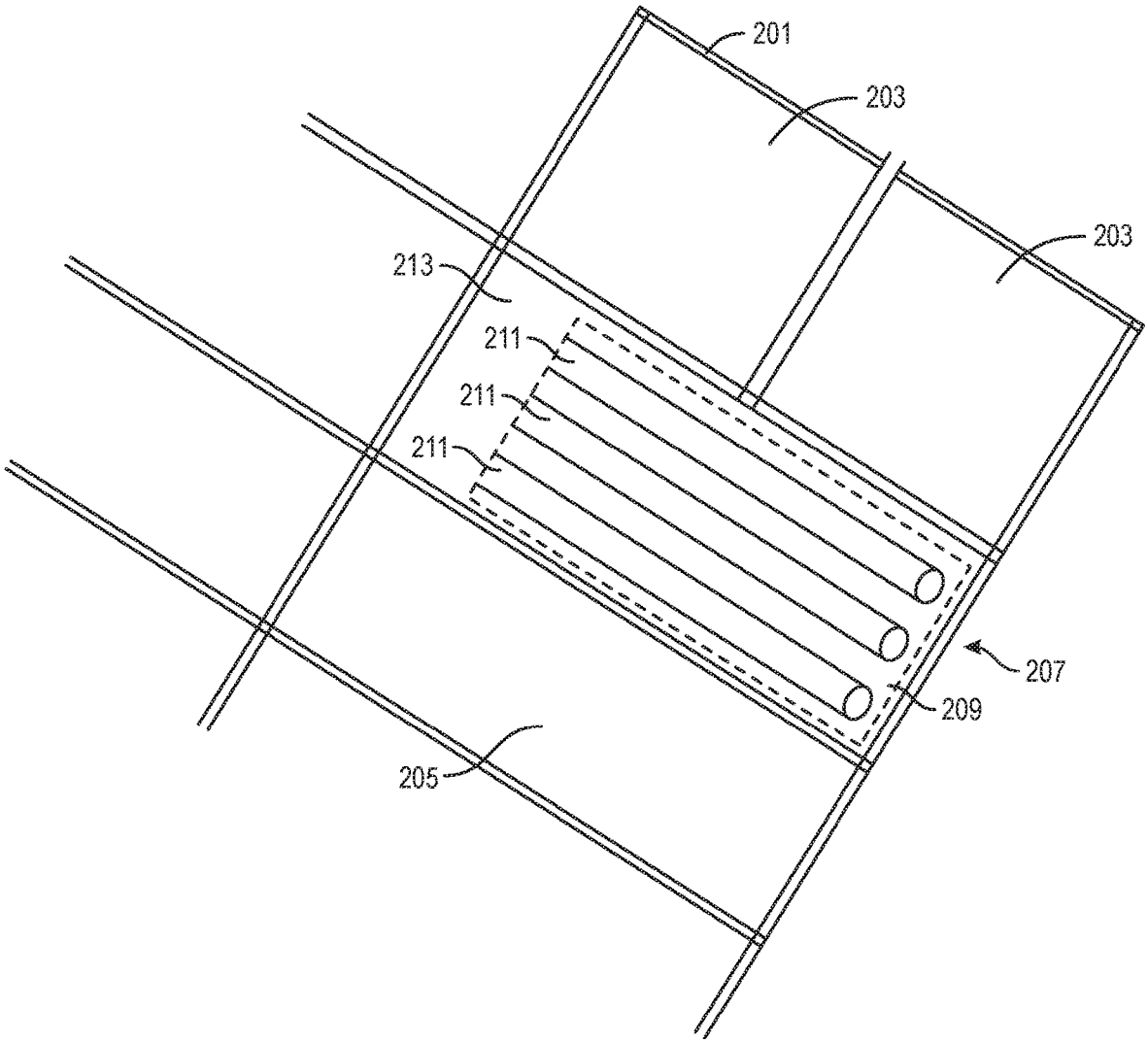
FIG. 2A is an illustration of an existing troffer light fixture in a dropped ceiling according to an exemplary embodiment.

Referring now to FIG. 2A an existing ceiling system and existing troffer light fixture are illustrated according to one embodiment. The ceiling system may be a dropped ceiling including one or more T-bars 201, 2×2 ceiling tiles 203, 2×4 ceiling tiles 205, and/or other components. The ceiling system may include one or more existing troffer light fixtures 207. As described herein, existing troffer light fixture 207 can be retrofit using troffer door retrofit system 100.

Existing troffer light fixture 207 can include components such as lens 213, troffer housing 209, lamps 211, ballast, supply wires, and/or other components.

As described in greater detail with reference to FIG. 2B, troffer housing 209 can contain, secure, and/or support the other components of existing troffer light fixture 207. Troffer housing 209 can be secured by T-bar 201 of the ceiling system. For example, troffer housing 209 may rest on T-bar 201. Troffer housing 209 may also be or include a reflector for directing light emitted from one or more lamps down from the ceiling system.

The ceiling system may include a plurality of T-bars 201 which form a ceiling grid. The ceiling grid typically has dimensions such that ceiling tiles 2' by 2' (e.g., 2×2 ceiling tile 203) and/or ceiling tiles 2' by 4' (2×4 ceiling tile 205) are supported by the T-bars 201. Existing troffer light fixture 207 is sized to be supported in one of a 2×2 grid location or 2×4 grid location. In further embodiments, the ceiling system may have other dimensions. The dimensions of other devices, systems, and components described herein may be adjusted to be compatible with the other dimensions.

Typically, troffer housing 209 of existing troffer light fixture 207 includes a plurality of slots which allow a panel or door to attach to troffer housing 209. The panel or door may open and close (e.g., using latches and hinges) to allow access to other components of existing troffer light fixture 207. For example, the panel or door may be opened to change one or more lamps 211 of existing troffer light fixture 207. The panel or door may be or include a lens 213 or louver. The panel or door may also be removable from troffer housing 209 (e.g., unlatched and the hinges removed from the slots included in troffer housing 209). As described herein, the panel or door of existing troffer light fixture 207 may be removed and door assembly 101 of troffer door retrofit system 100 may be installed using the slots included in the troffer housing 209 of the existing troffer light fixture 207.

In some embodiments, existing troffer light fixture 207 may not include slots for a panel or door or may include slots which are not compatible with door assembly 101 of troffer door retrofit system 100. Adaptor brackets 103 may be used in conjunction with troffer housing 209 in such cases.

Existing troffer light fixture 207 may be sized to be compatible with differently sized ceiling systems. For example, troffer housing 209 may be sized the same or approximately the same as 2×2 ceiling tile 203 or 2×4 ceiling tile 205. Existing troffer light fixture 207 may therefore be secured by T-bar 201 of the ceiling system in any location sized for a corresponding ceiling tile. Advantageously, door assembly 101 and/or adaptor brackets 103 of troffer door retrofit system 100 may be sized either for a 2×2 ceiling system location, a 2×4 ceiling system location, or other sized systems.

With continued reference to FIG. 2A, in some cases, lamps 211 may be florescent lamps. Florescent lamps are commonly used in troffer light fixtures (e.g., existing troffer light fixture 207). For example, existing troffer light fixtures 207 often include florescent lamps when used in such applications as industrial lighting, office space lighting, and/or other commercial or residential use with engineered ceilings (e.g., dropped ceilings). Door assembly 101 of troffer door retrofit system 100 includes LEDs in some embodiments. In such embodiments, door assembly 101 as installed as part of troffer door retrofit system 100 has several advantages over existing troffer light fixture 207 having florescent lamps 211. For example, door assembly 101 may reduce energy consumption by up to 70% or more in comparison to existing troffer light fixtures 207 having florescent lamps. Door assembly 101 and the LEDs included therein can have a longer life than florescent lamps. Therefore, maintenance related to the replacement of lamps is reduced thereby reducing maintenance costs and freeing up maintenance man hours for other tasks. LEDs of door assembly 101 also generate less heat than florescent lights thereby reducing the load on heating ventilation and air conditioning systems and reducing costs. Additionally, LEDs included in door assembly 101 include fewer hazardous waste materials than florescent lamps. As such, the LEDs of door assembly 101 are easier to recycle at the end of their life cycle than florescent lamps. Continuing the examples, the LEDs in door assembly 101 can provide a volumetric, even distribution of light with higher quality color rendering. The color temperature of LEDs may also be easily customizable and/or changed (e.g., controlled with a controller or selected during manufacture). Therefore, the light produced by door assembly 101 including LEDs may be of superior quality in comparison to light produced by florescent lamps included in existing troffer light fixture 207.

Figure 2B:
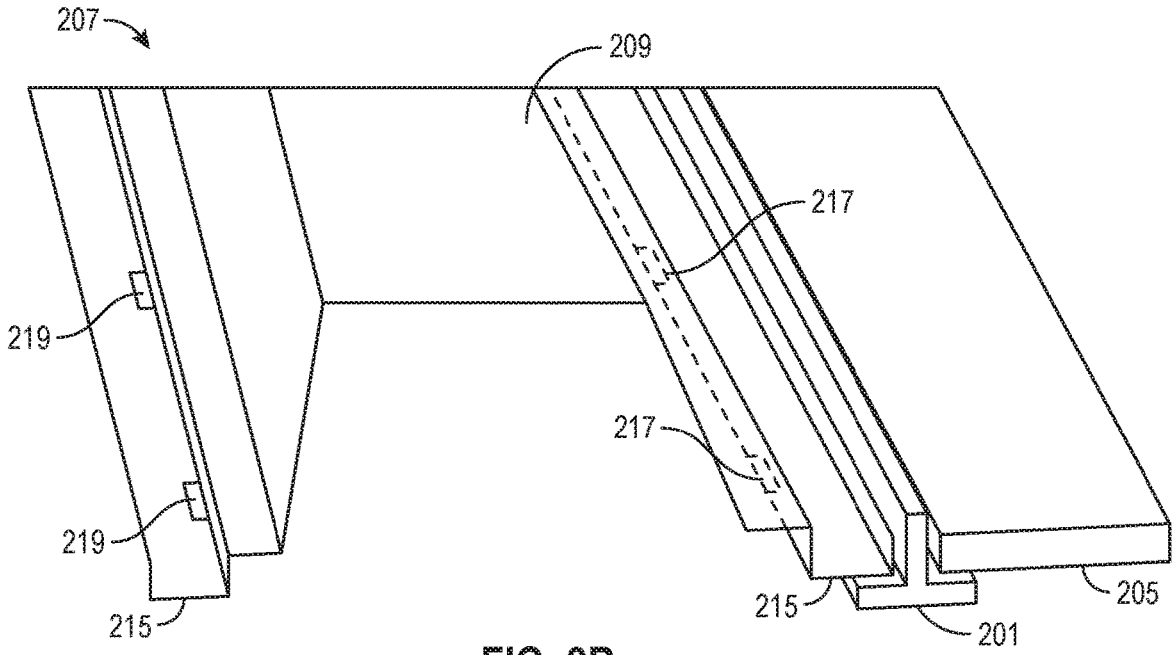
FIG. 2B is an illustration of an existing troffer housing of an existing troffer light fixture in dropped ceiling system according to an exemplary embodiment.

Referring now to FIG. 2B, a troffer housing 209 of existing troffer light fixture 207 is illustrated in relation to T-bar 201 of a ceiling system according to one embodiment. Troffer housing 209 rests on T-bar 201 of the ceiling. T-bar 201 includes a horizontal portion on which troffer housing 209 rests. Two or four sides of troffer housing 209 rest on T-bars 201; one T-bar 201 corresponding to each side of troffer housing 209. The horizontal portion of each T-bar 201 and the spacing of each T-bar 201 in the ceiling grid prevents troffer housing 209 from falling through the ceiling system. Troffer housing 209 may be prevented from shifting relative to the opening between T-bars 201 by the vertical portion of T-bar 201. This may prevent lateral movement of troffer housing 209. T-bars 201 are also configured to support ceiling tiles (e.g., 2×4 ceiling tile 205) using the same principles. T-bars 201 may be suspended or supported from a structural ceiling (e.g., as in a dropped ceiling).

Troffer housing 209 can be supported by T-bars 201 using flanges 215. Flanges 215 may have a variety of configurations. In one embodiment, flanges 215 include a first vertical portion extending downward from troffer housing 209, a horizontal portion which rests on T-bar 201, and an additional vertical portion (e.g., for preventing lateral movement of troffer housing 209 in conjunction with the vertical portion of T-bar 201). In further embodiments, flanges 215 may have other configurations. For example, flanges 215 may meet T-bar 201 at an angle (e.g., 45 degrees), flanges 215 may not include a second or additional vertical portion, etc.

As described later in more detail, adaptor brackets 103 of troffer door retrofit system 100 are configured to be held in place against T-bar 201 in some embodiments. Adaptor brackets 103 may be inserted between the horizontal portion of flange 215 and the horizontal portion of T-bar 201. Adaptor brackets 103 may be prevented from moving laterally by engaging a portion of flange 215 such as the additional vertical portion. As a result, a portion of adaptor bracket 103 may be located between the end of flange 215 (e.g., an end formed by the additional vertical portion) and the vertical portion of T-bar 201. Adaptor brackets 103 can be further configured to extend horizontally so as to avoid interference with the remainder portion of flange 215 and/or other portions of troffer housing 209.

In alternative embodiments, troffer housing 209 may be supported on T-bar 201 using the top of the vertical portion of T-bar 201 and a support mechanism attached to troffer housing 209. Troffer housing 209 may include a portion which extends at least to the horizontal portion of T-bar 201 and may overlap with T-bar 201. This may give the appearance that existing troffer light fixture 207 is flush or nearly flush with the ceiling system. In such embodiments, adaptor bracket 103 may be held in place using a combination of T-bar 201 and the above described portion of troffer housing 209 which extends near to or overlapping with the horizontal portion of T-bar 201.

From flange 215, troffer housing 209 may extend vertically and/or horizontally to a top portion. The top portion may continue until the flange and upward extension is mirrored to meet a second T-bar 201. For example and as illustrated in FIG. 2B, troffer housing 209 may have a generally trapezoidal profile with an internal space for the components of existing troffer light fixture 207 such as florescent lamps, lamp holders, and ballast. The side and/or top portions of troffer housing 209 may be coated with a reflective material. The reflective material may be used to redirect light from lamps 211 downward from the ceiling and/or laterally from the fixture. In some embodiments, the light source included in door assembly 101 of troffer door retrofit system 100 is positioned so as to use the troffer housing 209 to reflect emitted light downward and/or laterally from the ceiling.

The geometry of door assembly 101 of troffer door retrofit system 100 may be configured such that a portion of door assembly 101 is contained within troffer housing 209. For example, door assembly 101 may have the same or similar profile as compared to the panel or door of existing troffer light fixture 207 when the door assembly 101 is installed and viewed from below.

Troffer housing 209 may also include slots for use with a panel or door as previously described. Troffer housing 209 can include one or more hinge slots 217. Hinge slots 217 are configured to accept a hinge portion (e.g., an extended flange) of the panel or door. For example, hinge slots 217 may include a first opening and a second smaller opening connected to the first opening. The hinge portion of the panel or door may be shaped so as to fit through the first opening, move down, and be prevented from exiting the hinge slot by the second smaller opening which is smaller than the hinge portion of panel or door. The panel or door can then be removed from troffer housing 209 by lifting the panel or door and removing the hinge portion from larger portion of hinge slot 217 (e.g., the first opening). Hinge slot 217 can be located on flange 215.

In some embodiments, two hinge slots 217 are included in troffer housing 209. Door assembly 101 of troffer door retrofit system 100 can include two hinges (e.g., extended flanges) such that door assembly 101 can be hung from hinge slots 217. In other embodiments, troffer housing 209 may include a different number of hinge slots 217. For example, one or three hinge slots 217 may be included. Continuing the example, troffer housing 209 may include no hinge slots 217. In such cases, door assembly 101 may include a corresponding number of hinges, or adaptor brackets 103 may be used to hang door assembly 101.

Troffer housing 209 can also include one or more latch slots 219. Latch slot 219 may be an opening in troffer housing 209 (e.g., an opening in flange 215). Latch slot 219 allows a hook portion of a latch on the panel or door to extend through troffer housing 209 and hook onto or otherwise interface with a portion of troffer housing 209. For example, a hook portion of a latch may extend through latch slot 219 from below and rotate vertically to rest on or engage a horizontal portion of troffer housing 209 (e.g., flanges 215).

In some embodiments, two latch slots 219 are included in troffer housing 209. Door assembly 101 of troffer door retrofit system 100 can include two latches (e.g., rotatable latches with a grip and hook portion) such that door assembly 101 can be latched to latch slots 219. In other embodiments, troffer housing 209 may include a different number of latch slots 219. For example, one or three latch slots 219 may be included. Continuing the example, troffer housing 209 may include no latch slots 219. In such cases, door assembly 101 may include a corresponding number of latches, or adaptor brackets 103 may be used to hang door assembly 101.

Figure 3A:
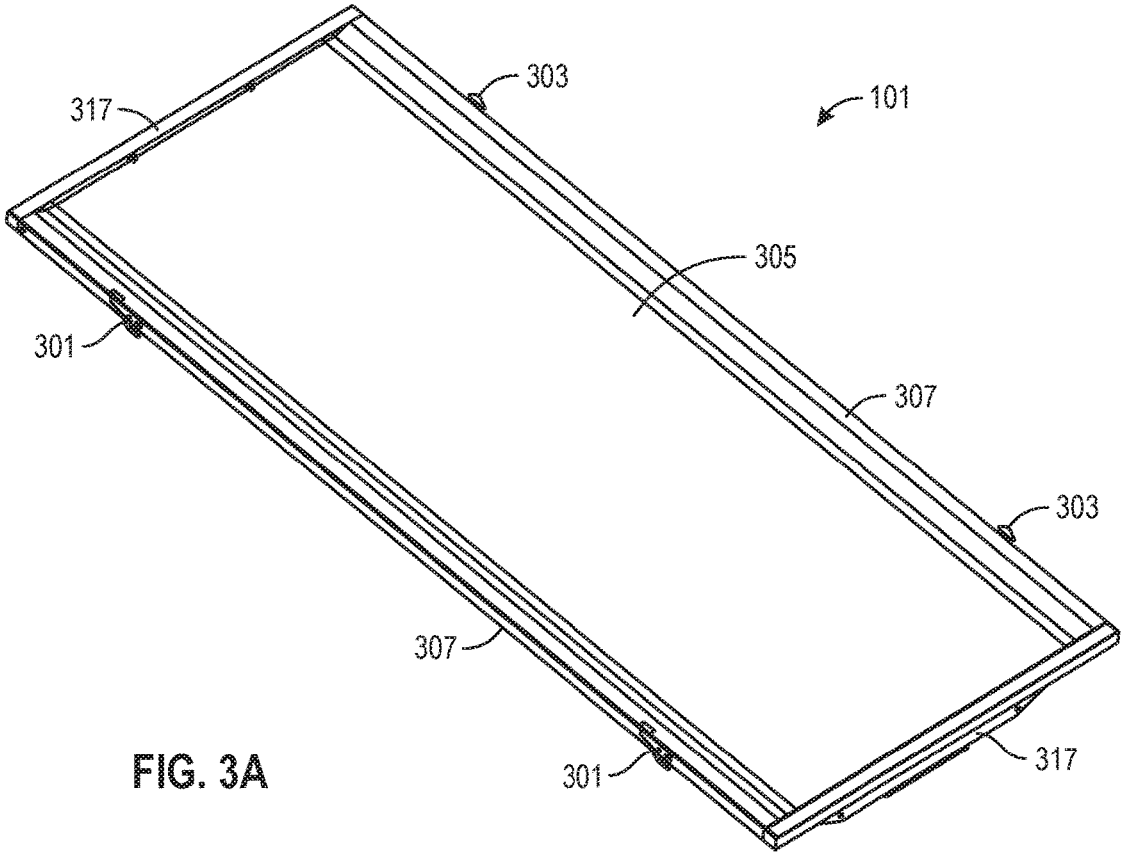
FIG. 3A is an illustration of a troffer door assembly according to an exemplary embodiment.
Figure 3B:
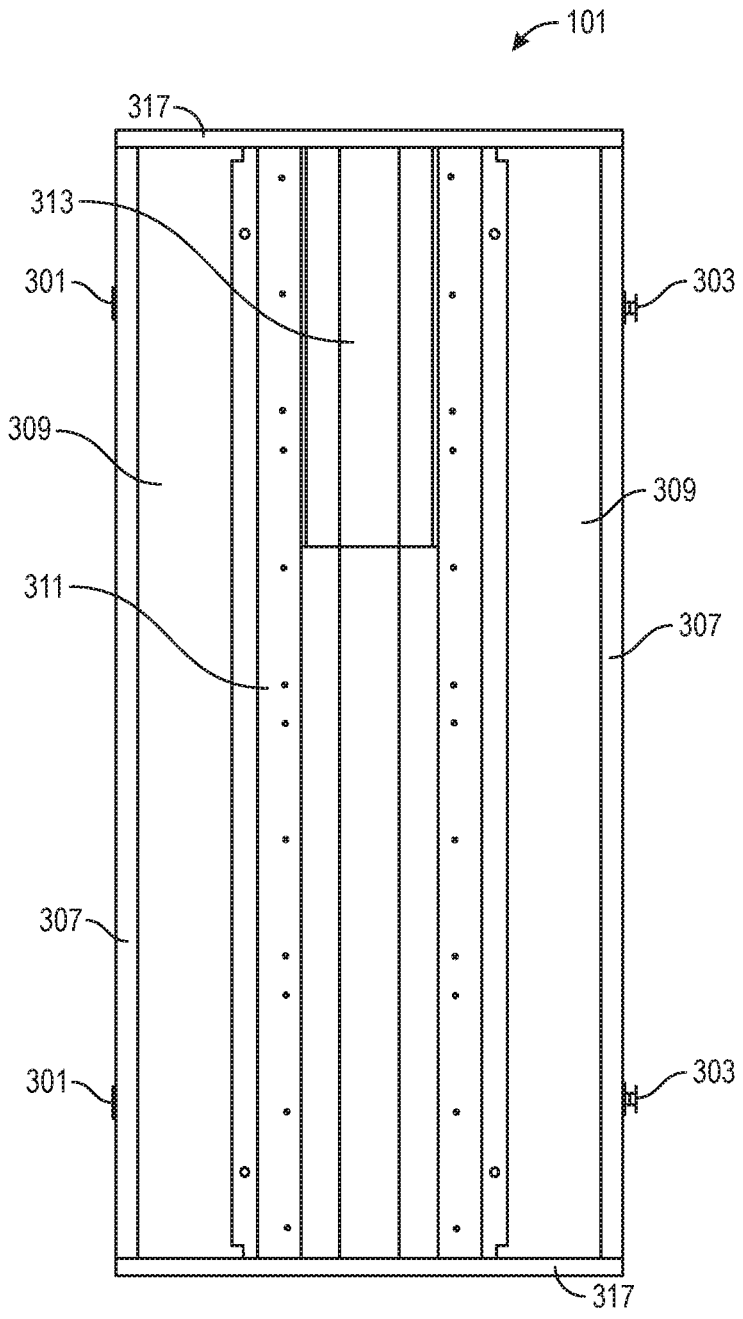
FIG. 3B is an illustration of a top view of a troffer door assembly according to an exemplary embodiment.
Figure 3C:
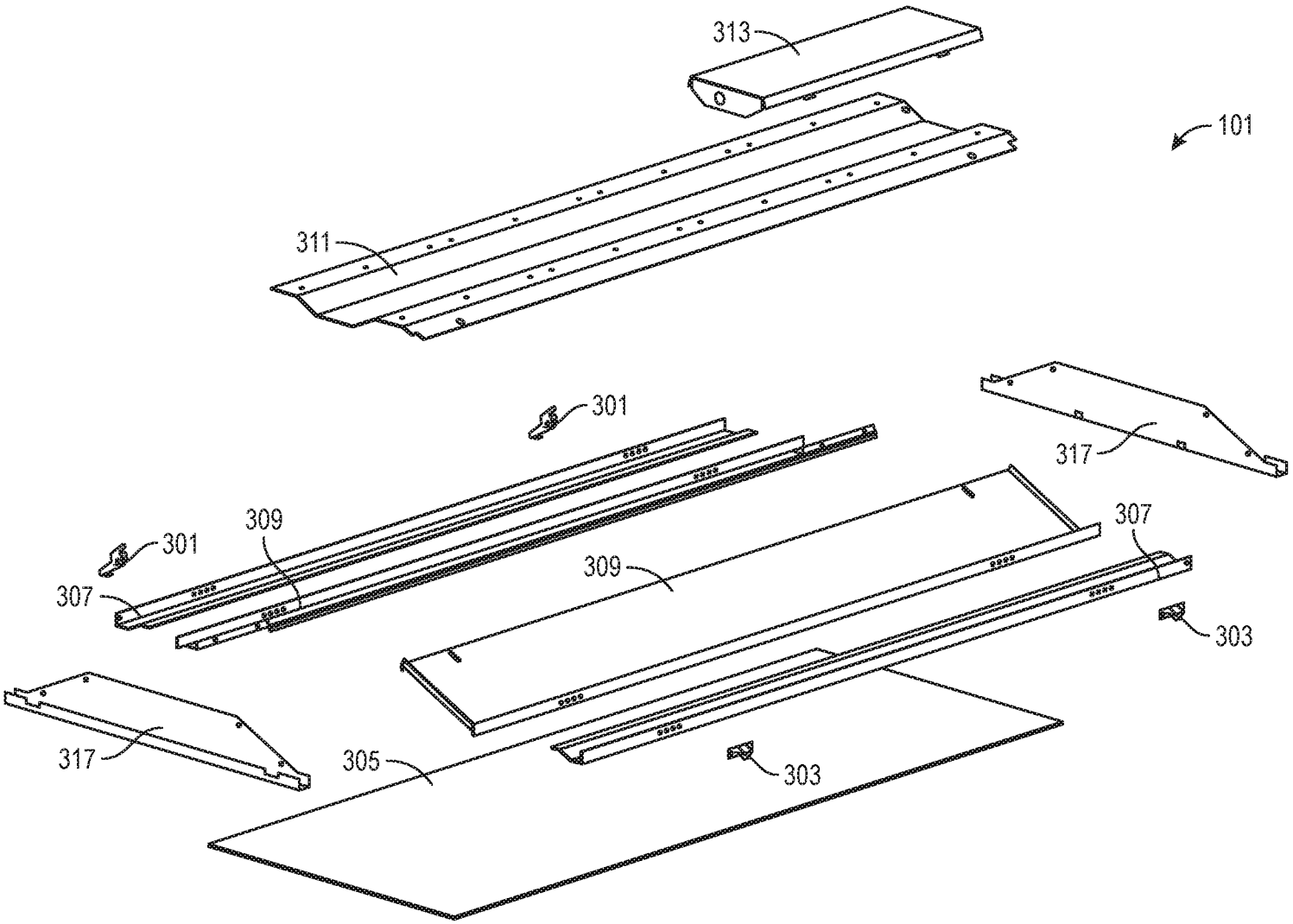
FIG. 3C is an exploded view illustration of a troffer door assembly according to an exemplary embodiment.

Referring now to FIGS. 3A-3C, door assembly 101 is illustrated according to one embodiment. As previously described, door assembly 101 of troffer door retrofit system 100 is hung using troffer housing 209 and/or adaptor brackets 103. The lamps within door assembly 101 can be wired to the power supply for an existing troffer light fixture 207. One or more components of existing troffer light fixture 207 can be removed, and door assembly 101 can be closed and latched. As a result, existing troffer light fixture 207 is retrofitted (e.g., to include LED lamps rather than existing florescent lamps).

Referring now to FIG. 3A. door assembly 101 includes a housing which may include a plurality of components such as lower side frames 307, frame ends 317, hinges 303, latches 301, and a lens 305. Multiple components may be attached together such that door assembly 101 does not require assembly when purchased by a consumer. In other words, door assembly 101 may be manufactured using a plurality of components which are permanently or semi-permanently assembled to create door assembly 101.

The frame components may be assembled or joined such that the frame provides structural support to door assembly 101. The frame may further provide one or more mounting points or surfaces for additional components of door assembly 101. Lower side frame 307 can be joined or attached to frame ends 317. This may form a square or rectangular frame on which other components are attached or joined. Latches 301 are attached or joined to lower side frame 307. Hinges 303 are attached or joined to the opposite lower side frame 307.

In some embodiments, door assembly 101 includes lens 305. Lens 305 can be transparent or translucent such that light emitted from a light source in door assembly 101 exits lens 305 to an area below door assembly 101. Lens 305 may enhance the performance of the retrofitted troffer light fixture. For example, lens 305 may be used to diffuse light, focus light, form one or more beams, filter light, and/or otherwise alter or manipulate light emitted from a light source included in door assembly 101. Alternatively, lens 305 may not substantially alter the light exiting lens 305. In further embodiments, lens 305 protects one or more components within door assembly 101. For example, lens 305 may limit access to LEDs included in door assembly 101.

Lens 305 can be supported by and/or attached to lower side frames 307 of door assembly 101. In some embodiments, lens 305 is removable from door assembly 101. This may allow access to one or more other components of door assembly 101. For example, removing lens 305 may provide access to lamps, supply wiring, electronics, controllers, and/or other components. This allows for replacement or repair of components (e.g., replacing lamps). In some embodiments, lens 305 may rest on a portion of lower side frames 307 and/or frame ends 317. Lens 305 may be made of a deformable material (e.g., is plastically deformable) such that lens 305 may be deformed and removed from the frame of door assembly 101. Lower side frames 307 and/or frame ends 317 may include a track or channel which lens 305 is inserted into. This may secure lens 305. In alternative embodiments, lens 305 may be mounted on one or more hinges and/or include one or more latches or other features which non-permanently secure lens 305 in the frame of door assembly 101. This may allow lens 305 to be opened and provide access to internal components of door assembly 101.

Lens 305 may be made of a transparent or translucent material. In some embodiments, lens 305 is made of glass or another ceramic material. In other embodiments, lens 305 is made of acrylic or polycarbonate. Alternatively, lens 305 may be made of other polymers or plastics. In alternative embodiments, lens 305 may be a louver. In further alternative embodiments, door assembly 101 does not include a lens 305.

Referring now to FIG. 3B, a top view of door assembly 101 is illustrated according to one embodiment. Door assembly 101 may include additional components such as upper side frame 309, top portion 311, and cover 313. Upper side frames 309 may form the top of the housing of door assembly 101. As illustrated in FIG. 3C, door assembly 101 may have a trapezoidal shape. Frame ends 317 form the trapezoidal ends of door assembly 101, lower side frames 307 and lens 305 form the bottom, and upper side frames 309 form the angled top portion. Referring again to FIG. 3B, upper side frames 309 are attached or joined to lower side frames 307. Upper side frames 309 may also be attached to or joined to frame ends 317. Upper side frames 309 are further attached to top portion 311. Top portion 311 forms the top of the trapezoidal housing of door assembly 101. Located on top of top portion 311 is cover 313. Cover 313 can cover electronic components (e.g., controllers, ballast, connections to supply wires, and/or other electronics) mounted on top portion 311 or otherwise contained within the space formed by cover 313 and top portion 311.

In some embodiments, upper side frame 309 and/or top portion 311 are configured to reflect light from within door assembly 101 out through lens 305. For example, one or more of upper side frame 309 and/or top portion 311 may be coated with a reflective material on the side facing lens 305. Alternatively, one or more of upper side frame 309 and/or top portion 311 may be constructed of a reflective material (e.g., a metal). In still further embodiments, door assembly 101 uses troffer housing 209 of existing troffer light fixture 207 as a reflector. For example, door assembly 101 may not include upper side frames 309, may not include top portion 311, or upper side frames 309 and/or top portion 311 may include an opening to troffer housing 209 of existing troffer light fixture 207.

Referring now to FIGS. 3A-3C, door assembly 101 also includes a light source (not illustrated). The light source may be any device or component configured to produce light, typically visible light, using electricity. In one embodiment, the light source is one or more LEDs. For example, the LEDs may be individual LEDs, LED ribbons including a plurality of LEDs, an LED string containing a plurality of LEDs, or another device or package including LEDs. The LEDs may be mounted anywhere in or on the housing of door assembly 101 such that light exits the housing through lens 305 or the area where lens 305 would normally be. For example, LEDs (e.g., two strips of LEDs) may be attached to the surface of top portion 311 facing lens 305. Electronics used to control or otherwise support the functions of the LEDs may be located in cover 313. A wiring harness, supply wires, and/or other electrical connections may be coupled to the LEDs to provide electrical power. The wiring harness, supply wires, and/or other electrical connections may exit cover 313. This may allow for easy retrofitting of an existing troffer light fixture 207 as the wiring harness or supply wires may be quickly connected to or wired to supply wires for the existing troffer light fixture 207. For example, the lens of the existing troffer light fixture 207 may be removed, and door assembly 101 hung from either troffer housing 209 or adaptor brackets 103. The lamps and ballast cover of the existing troffer light fixture 207 may be removed and the supply wires to the ballast disconnected. The wiring harness or supply wires of door assembly 101 may then be connected to the existing supply wires which were previously connected to the ballast of existing troffer light fixture 207.

In alternative embodiments, the LEDs may be located elsewhere in or on the housing of door assembly 101. For example, the LEDs may be mounted on the side of top portion 311 facing troffer housing 209. The LEDs may extend through one or more openings in top portion 311 and into the interior of the housing of door assembly 101. As an additional example, the LEDs may be mounted on one or more of upper side frame 309. Alternatively, the LEDs may be mounted on a brace member (not illustrated) located within the housing of door assembly 101 and above lens 305. LEDs may be positioned to emit light towards lens 305 and/or towards top portion 311 and/or upper frame side 309 (e.g., these components may act as reflectors as previously described).

In other embodiments, the light source may be a lamp such as a florescent lamp or incandescent lamp. The light source may be attached to one or more components of door assembly 101 such that light is emitted within the housing and exits through lens 305. For example, the light source may be attached to the inside of top portion 311. The light source may be attached with hardware such as lamp holders. Ballast, controllers, and/or other electronics for use with the light source may be located between cover 313 and top portion 311.

Still referring to FIGS. 3A-3C, components may be attached to one another or joined together as described above. In various embodiments, various techniques may be used to assemble the components described herein. For example, screws, rivets, nuts and bolts, and/or other fasteners may be used to attach components to each other. Continuing the example, glues, drying adhesives, pressure-sensitive adhesives, contact adhesives, hot adhesives, reactive adhesives, adhesive tape, and/or other adhesives may be used to attach one component to another or otherwise join components. Components may also be attached or joined using welding or similar techniques (e.g., TIG welding, MIG welding, spot welding such as resistive spot welding, ultrasonic welding, and/or other techniques).

In some embodiments, door assembly 101 may include a single housing which is produced as one piece of material. For example, a housing (e.g., including lower side frame 307, upper side frame 309, frame ends 317, top portion 311, and/or other components) may be a single component made by stamping, machining, printing, extruding, casting, injection molding, and/or other manufacturing techniques.

Referring now to FIG. 3C, an exploded view of door assembly 101 is shown according to one embodiment. As illustrated, components of door assembly 101 may include mounting points (e.g., indentations, holes, etc.) for attaching or joining two or more components. For example, lower side frame 307 and upper side frame 309 may both include mounting points at corresponding locations on flanges for attaching lower side frame 307 to upper side frame 309. Fasteners may be used to attach or join the two components. Similarly, attachment points on lower side frame 307 and/or upper side frame 309 may be used in conjunction with fasteners to attach hinges 303 and/or latches 301.

Lower side frames 307 and/or frame ends 317 may include channels. The channels may give the appearance that door assembly 101 is flush with T-bar 201 when installed. Lower side frames 307 may also include a flange or other horizontal surface for receiving and/or supporting lens 305. Flanges may be included in other components and used for a variety of purposes. For example, flanges may provide additional strength to components (e.g., acting as a U beam). As an additional example, flanges may provide a surface on which to apply adhesives, spot weld two components, or otherwise facilitate the joining of two components or the attachment of one component to another.

Referring generally to FIGS. 3A-3C, the components of door assembly 101 described herein may be made of a variety of materials and using a variety of manufacturing techniques. In some embodiments, one or more components are made of a metal or a plurality of metals. For example, components may be made of aluminum, steel, tin, and/or other metals or alloys. In some embodiments, one or more components are made of plastics or polymers. For example, components may be made of or include acrylic, polycarbonate, polyvinyl chloride, or other polymers. In further embodiments, one or more components may be made of ceramic materials.

Alternative embodiments of door assembly 101 are possible. In some embodiments, troffer door assembly 101 includes a variety of sizes. For example, troffer door assembly 101 may be sized to fit 2×2, 2×4, 1×4, or other size ceiling grid openings. In further embodiments, components of troffer door assembly 101 vary. For example, lens 305 can be a flat lens, contour lens, or combination lens (e.g., segmented lens). The height, geometry (e.g., trapezoidal, rectangular, etc.), and/or configuration of troffer door assembly 101 may also vary. For example, cover 313 may be located on a side rather than the top of troffer door assembly 101.

Figure 4:
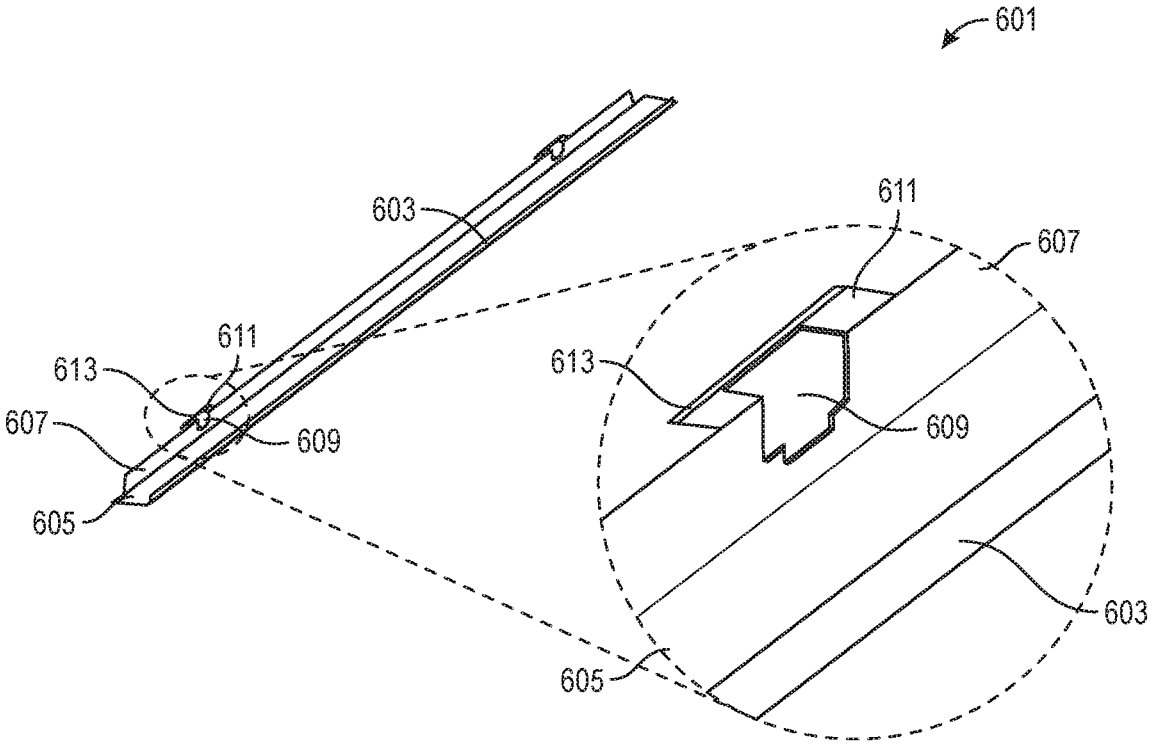
FIG. 4 is an illustration of an adaptor bracket according to an exemplary embodiment.

Referring now to FIG. 4, adaptor bracket 601, one embodiment of adaptor bracket 103 previously described herein, is illustrated according to an exemplary embodiment. As previously described herein, adaptor bracket 103, and the embodiment of adaptor bracket 601 illustrated herein, is configured for use in retrofitting an existing troffer light fixture 207. Adaptor bracket 601 can be placed between a troffer housing 209 of an existing troffer light fixture 207 and a T-bar 201 of a ceiling system. Troffer housing 209 keeps adaptor bracket 601 in place in some embodiments (e.g., the weight of troffer housing 209). Adaptor bracket 601 includes a plurality of slots 609 which accept both a hinge 303 and latch 301 depending on which is inserted into slot 609. Door assembly 101 is hung from the slots 609 on one adaptor bracket 601 using hinges 303 and is latched in a closed position by securing latches 301 through slots 609 on a second adaptor bracket. The second adaptor bracket 601 is located on the opposite side of troffer housing 209 from the first adaptor bracket 601.

Referring further to FIG. 4, adaptor bracket 601 is illustrated along with a more detailed view of slot 609 and the surrounding portions according to one embodiment. Adaptor bracket 601 may be generally U shaped with a channel 605, lip 603, and side 607. Channel 605 is configured (e.g., sized) to accept a portion of troffer housing 209 of an existing troffer light fixture 207. For example, the end of troffer housing 209 or a flange of troffer housing 209 can rest on or in channel 605. The weight of troffer housing 209 may secure adaptor bracket 601 against a T-bar 201 of the ceiling system.

In some embodiments, adaptor bracket 601 includes lip 603. Lip 603 can engage with an end or flange of troffer housing 209. Lip 603 can prevent adaptor bracket 601 from sliding horizontally and away from T-bar 201. Troffer housing 209 may push against lip 603 in the direction of T-bar 201.

Referring further to FIG. 4, channel 605 extends beyond T-bar 201. Channel 605 may extend from T-bar 201 such that side 607 is positioned to extend within troffer housing 209. Advantageously, this may allow slots 609 of adaptor bracket 601 to be higher than the lowest surface of troffer housing 209. This allows door assembly 101 to be mounted using slots 609 in such a way as door assembly 101 is flush or nearly flush with troffer housing 209. This may improve the aesthetics of an existing troffer light fixture 207 retrofit using troffer door retrofit system 100.

In alternative embodiments, side 607 may be at an angle to channel 605. This may allow channel 605 to be narrower (e.g., approximately the width of the end or flange of troffer housing 209). Side 607 can extend vertically and horizontally such that slot 609 is positioned within troffer housing 209. In further alternative embodiments, side 607 may be at a downward angle relative to channel 605. This may lower slot 609 relative to troffer housing 209 of existing troffer light fixture 207. Advantageously, this may provide more clearance for door assembly 101 to fit at least partially within troffer housing 209 when hung and closed. This may make troffer door retrofit system 100 compatible with a wider variety of existing troffer light fixtures 207.

Slot 609 is configured to accept hinge 303 of door assembly 101 such that door assembly 101 can be hung from adaptor bracket 601 using slot 609. Slot 609 is configured to have a large opening and a small opening. As previously described, the large portion of the opening allows hinge 303, including an extended portion of the hinge, to be inserted through slot 609. Slot 609 also includes a smaller portion. When hinge 303 is lowered after being inserted into slot 609, the smaller portion of slot 609 prevents hinge 303 from exiting slot 609 (e.g., an extended portion of hinge is larger than the smaller opening of slot 609).

Slot 609 also extends to and into latch surface 611. Latch surface 611 is a horizontal surface onto which a hook portion of latch 301 engages. The hook portion of latch 301, when engaged, cannot exit slot 609 due to interference of latch surface 611. When latch 301 is in a disengaged position, the hook portion is rotated vertically and can exit slot 609.

In alternative embodiments, latch surface 611 is at an angle to side 607. In further alternative embodiments, slot 609 does not extend into latch surface 611. For example, latch surface 611 may contain, be made of, or include magnetic material or a magnet. Latch 301 may include a magnet as previously described for securing door assembly 101 to adaptor bracket 601.

In some embodiments, adaptor bracket 601 further includes flange 613. Flange 613 may extend at a downward angle from latch surface 611. Flange 613 may prevent accidental removal of hinge 303 from slot 609 by partially overhanging slot 609 and limiting access thereto. In other embodiments, adaptor bracket 601 does not include flange 613.

Still referring to FIG. 4, as illustrated, latch surface 611 and/or flange 613 may run for only a portion of the length of adaptor bracket 601. This may allow for the use of adaptor bracket 601 and troffer door retrofit system 100 with plenum rated ceilings (e.g., ceiling systems in which air returning to or being supplied by a heating ventilation and/or air condition system moves through the plenum space created by the drop ceiling and the structural ceiling). The ceiling system in which the troffer door retrofit system 100 is installed may be used to circulate air in the building containing the ceiling system.

To provide for air returns or air supply to or from the plenum space in the ceiling system, adaptor bracket 601 can be vented. Latch surface 611 and/or flange 613 may run for only a portion of the length of adaptor bracket 601 to provide for venting. When hung using hinges 303, latches 301, and the corresponding slots 609 and latch surfaces 611 of adaptor brackets 601, door assembly 101 may be separated from adaptor bracket 601 by a distance. In some embodiments, this distance is substantially the width of attachment surface 611 and/or flange 613. Therefore, in embodiments in which latch surface 611 and/or flange 613 do not run the entire length of adaptor bracket 601, a vent space is created between door assembly 101 and adaptor bracket 601. Advantageously, this vent space may be used as an air supply or air return for use in a plenum ceiling system (e.g., for return of room air and/or supply of conditioned air in a heating ventilation and/or air conditioning system). This feature of some embodiments of troffer door retrofit system 100 can be used to add additional supplies or returns when retrofitting existing troffer light fixtures 207 of a plenum ceiling system. This feature can also be used to retrofit existing troffer light fixtures 207 which include a supply or return for use in a plenum ceiling system.

In alternative embodiments, lip 603 of adaptor bracket 601 engages with T-bar 201. For example, lip 603 may be or include a hook which engages the vertical portion of T-bar 201. The hook portion of lip 601 may slip over the vertical portion of T-bar 201. Advantageously, this may prevent adaptor bracket 601 from moving horizontally relative to T-bar 201. Furthermore, adaptor bracket 601 may be held in place by the hook portion without relying on or using the weight of troffer housing 209 to secure adaptor bracket 601.

In other alternative embodiments, adaptor bracket 601 does not rest on or connect to T-bar 201. For example, adaptor bracket 601 may be mounted to troffer housing 209 of an existing troffer light fixture 207. Adaptor bracket 601 may include a hook, latch or other mechanism to attach adaptor bracket 601 to troffer housing 209 using existing slots in troffer housing 209.

Figure 5:
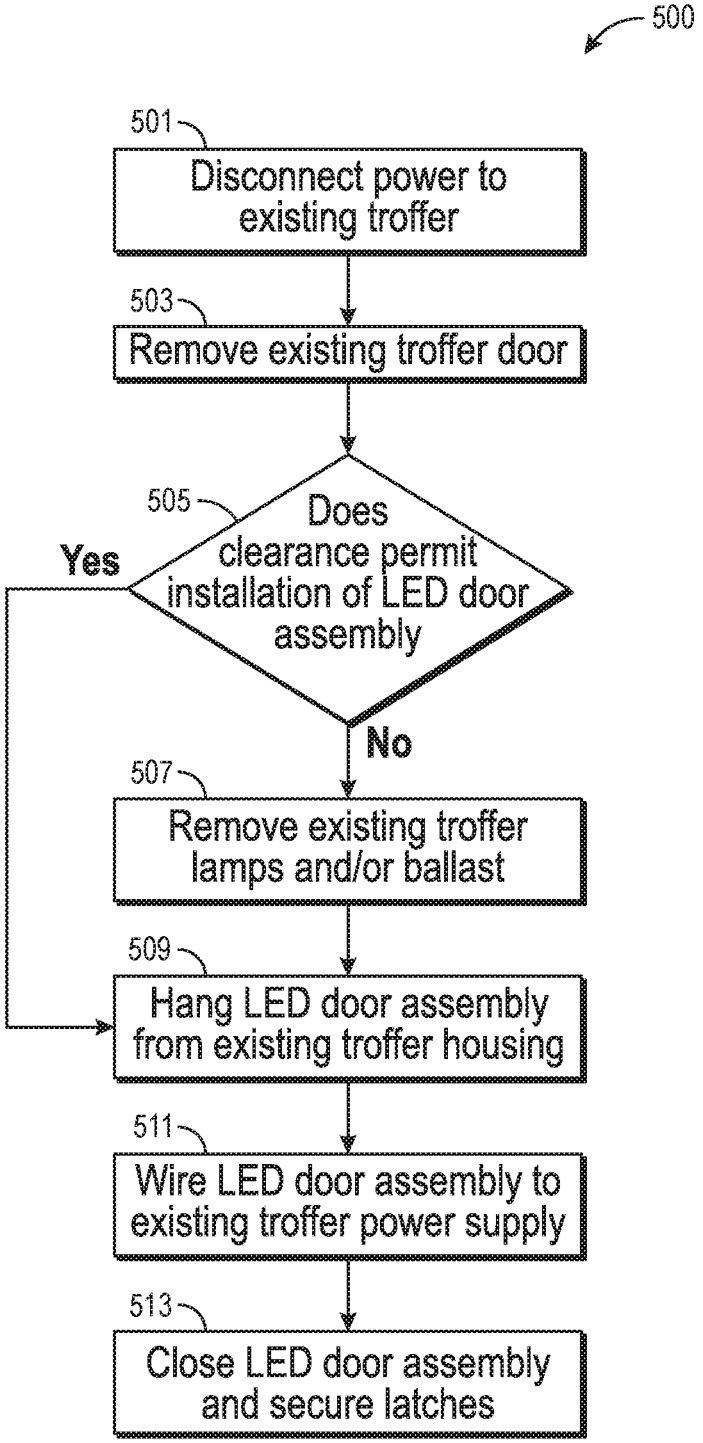
FIG. 5 is an illustration of flow chart for retrofitting an existing troffer light fixture using a door assembly according to an exemplary embodiment.

Referring now to FIG. 5, a flow chart of method 500 for retrofitting an existing troffer light fixture 207 using troffer door retrofit system 100 is shown. An installer disconnects power to the existing troffer light fixture 207 (501). For example, an installer may turn off a light switch which controls the electrical supply (e.g., interrupts the electrical supply) to existing troffer light fixture 207. As an alternative example, an installer can disconnect power to existing troffer light fixture 207 using a breaker.

The installer can remove the door of the existing troffer light fixture 207 (503). In some embodiments, the installer removes the door after disconnecting the power. In alternative embodiments, the installer removes the door prior to turning off the power. As previously described herein, the existing troffer light fixture 207 can include a door. The door may be or include the lens or a louver of the existing troffer light fixture 207. Removing the door can include unlatching the door from the troffer housing 209 of the existing troffer light fixture 207. Removing the door can also include unhinging the door from the troffer housing 209. For example, the hinges of the door may be lifted out of slots included in the troffer housing 209.

The installer may determine if clearance in the housing 209 of the existing troffer light fixture 207 is sufficient to permit installation of door assembly 101 (505). This can include taking one or measurements. This may also or alternatively include consulting an instruction manual with instructions for retrofitting a particular existing troffer light fixture 207. For example, the instruction manual may have been prepared with the knowledge of the clearances of many types of existing troffer light fixtures 207. Based on the particular make or model of the existing troffer light fixture 207 being retrofit, the instructions may instruct the installer that clearance does or does not permit installation of door assembly 101 without removing one or more components of existing troffer light fixture 207.

If clearance does not permit installation of door assembly 101, the installer can remove lamps, a ballast cover, and/or the ballast of existing troffer light fixture 207 (507). Removing these components, a subset of these components, and/or other components of existing troffer light fixture 207 can provide sufficient clearance for the installation of door assembly 101.

If clearance does permit installation of door assembly 101, lamps, a ballast cover, ballast, and/or other components of existing troffer light fixture 207 may be left within troffer housing 209.

The installer can hang the door assembly 101 from the existing troffer housing 209 (509). As previously described herein, the hinges 303 of door assembly 101 can be configured to operate with slots of a troffer housing 209 of the existing troffer light fixture 207. Hanging door assembly 101 from the troffer housing 209 can include inserting hinges 303 of the door assembly 101 into a slot on troffer housing 209. Door assembly 101 can then be lowered such that hinges 303 do not exit the slots in troffer housing 209.

The installer can wire door assembly 101 to a power supply for the existing troffer light fixture 207 (511). This can include first removing power supply wires from the ballast or another component of the existing troffer light fixture 207. The power supply wires may then be wired (e.g., joined to, using a twist-on wire connector) to a power supply wire for door assembly 101. The power supply wire for door assembly 101 may be extending from a cover 313, electronics housing, or other portion of door assembly 101. The installer may also complete any wiring for other components of door assembly 101. For example, the installer may wire other electronics of door assembly 101 such as controllers and sensors to existing or newly installed components related to existing troffer light fixture 207. Alternatively, door assembly 101 can be wired to already existing components such as controllers or sensors included in or related to existing troffer light fixture 207.

The installer can close door assembly 101 and secure latches 301 of door assembly 101 (513). This can include positioning latches 301 of door assembly 101 in the disengaged position. The door assembly 101 can be closed by pivoting it on hinges 303. As door assembly 101 is closed, latches 301 can enter slots included in troffer housing 209. The latches can then be positioned in a closed position such that latches 301 interact with troffer housing 209 to prevent door assembly 101 from opening.

If at any point prior to or during the performance of method 500, the installer determines that the hinges 303 and/or latches 301 of door assembly 101 do not align with or are otherwise incompatible with troffer housing 209 of existing troffer light fixture 207, the installer may use adaptor brackets 103 to perform the retrofit. Additionally, if the installer determines that there is insufficient clearance even after removing components of existing troffer light fixture 207, the installer can use adaptor brackets 103 to perform the retrofit.

As described above and elsewhere herein, an existing troffer light fixture 207 can be retrofit using only door assembly 101. In other embodiments described later and elsewhere herein, an existing troffer light fixture 207 can be retrofit using adaptor bracket 103 as well. Advantageously, either method of retrofitting can be performed without the use of tools. For example, no fasteners, drills, screwdrivers, wire cutters, or other tools are required to complete the retrofit. In some embodiments, even the twist-on wire connector may be salvaged from existing troffer light fixture 207. In one embodiment, no tools are required to attach any component (e.g., adaptor bracket 103) to troffer housing 209 of existing troffer light fixture 207. Advantageously, retrofitting without the use of tools may decrease the time taken to perform the retrofit. This may reduce costs and/or otherwise speed up the retrofitting of one or a plurality of existing troffer light fixtures 207. The retrofit methods described herein may also allow for retrofitting of an existing troffer light fixture 207 without disruption of existing ceiling tiles and/or without the removal of existing fixtures. This may reduce the complexity and/or risk of damage from the retrofit process.

Figure 6:
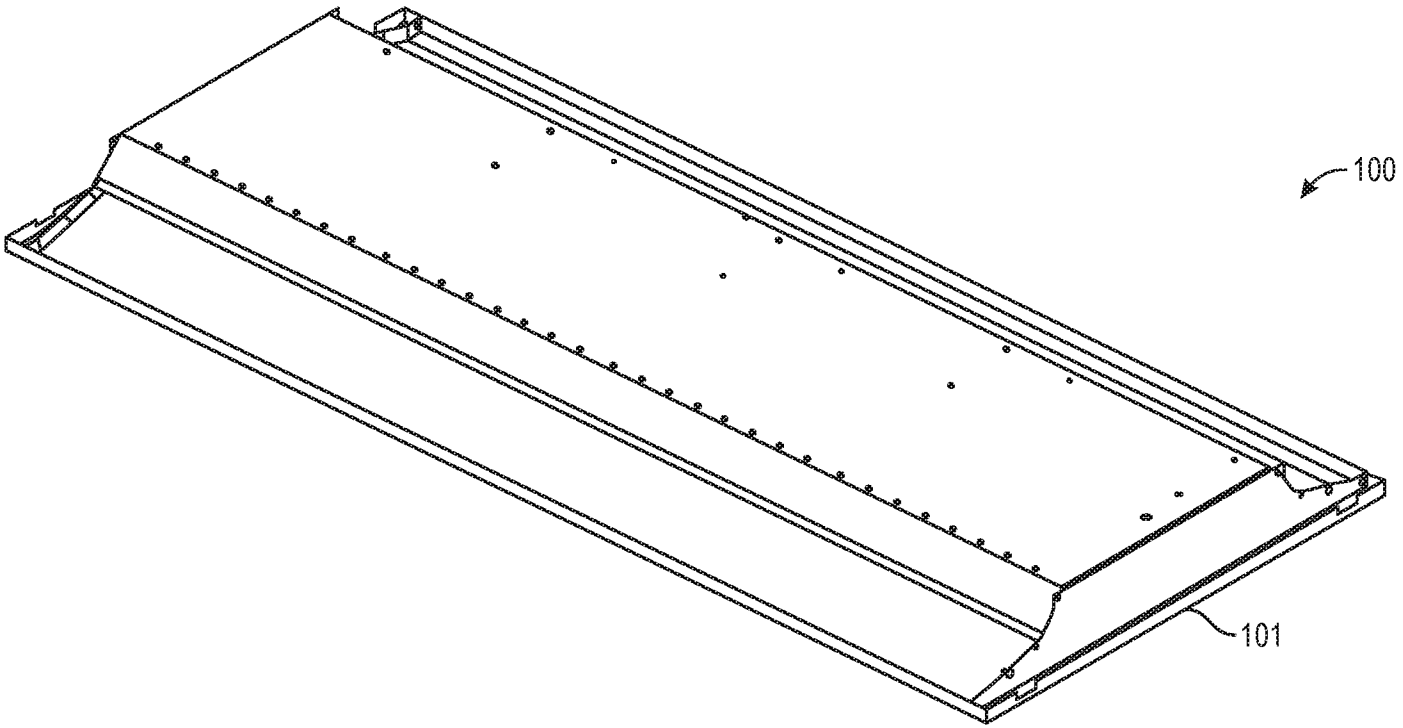
FIG. 6 is an illustration of a troffer retrofit system including a troffer door assembly without hinges or latches according to an exemplary embodiment.

Referring now to FIG. 6, troffer door retrofit system 100 does not include adaptor brackets 103 in some embodiments. Troffer door retrofit system 100 can be bracketless and attach to troffer housing 209 of existing troffer light fixture 207, a ceiling system, T-bars 201, or otherwise be mounted in a ceiling system using a system other than adaptor brackets 103. Troffer door retrofit system 100 includes door assembly 101. Door assembly 101 may include components and/or function as previously described (e.g., with respect to FIGS. 1-3C).

In some embodiments, door assembly 101 does not include hinges 303 and/or latches 301. As described in greater detail with reference to FIGS. 7A-11E, door assembly 101 includes various mounting systems in various embodiments. Bracketless troffer door retrofit system 100 provides for a plurality of advantages. Bracketless troffer door retrofit system 100 may include fewer parts reducing manufacturing expense and/or simplifying the installation process. Simplifying the installation process may increase the speed of the installation process resulting in greater efficiency. Bracketless troffer door retrofit system 100 may provide an additional advantage in that it is compatible with light fixtures which are secured to the ceiling system. In some cases, troffer housing 209 of existing troffer light fixtures 207 may be secured to T-bars 201 (e.g., screwed to T-bars 201) or otherwise permanently attached to the ceiling system. For example, troffer housing 209 may be secured for use in earthquake zones and/or hurricane prone areas. Troffer housing 209 may be secured to the ceiling system to comply with one or more building codes or requirements. This may prevent the insertion of adaptor bracket 103 between T-bars 201 and troffer housing 209. Advantageously, bracketless troffer door retrofit system 100 can be used to retrofit these light fixtures. Troffer housing 209 need not be lifted to install bracketless troffer door retrofit system 100 in some embodiments (e.g., door assembly 101 can be mounted to or otherwise attached to troffer housing 209, T-bars 201, and/or another portion of the ceiling system or existing light fixture).

Still referring to FIG. 6, in some embodiments door assembly 101 is permanently attached to existing troffer light fixture 207, troffer housing 209, T-bars 201, and/or other components in a ceiling system. Advantageously, door assembly 101 may include LEDs as a light source. The LEDs may have a life span long enough such that door assembly 101 need not be replaced and can therefore be permanently mounted in the ceiling system.

In alternative embodiments, door assembly 101 includes fewer components than illustrated and previously described with reference to FIGS. 1-3C. For example, door assembly 101 may not include top portion 311. In some embodiments, door assembly 101 includes only a light engine (e.g., LEDs or other lamps, drivers, control circuitry, and/or other electronics), frame, and lens. Advantageously, this may simplify installation and/or manufacturing process. In still further embodiments, door assembly 101 is mounted within existing troffer light fixture 207. Door assembly 101 can use components of existing troffer light fixture 207. For example, door assembly 101 may not include a lens but rather is mounted within existing troffer light fixture 207 such that door assembly 101 emits light through a lens of existing troffer light fixture 207. Various embodiments of door assembly 101 can be mounted using one or more of the techniques described herein with reference to FIGS. 7A-11E.

Figure 7A:
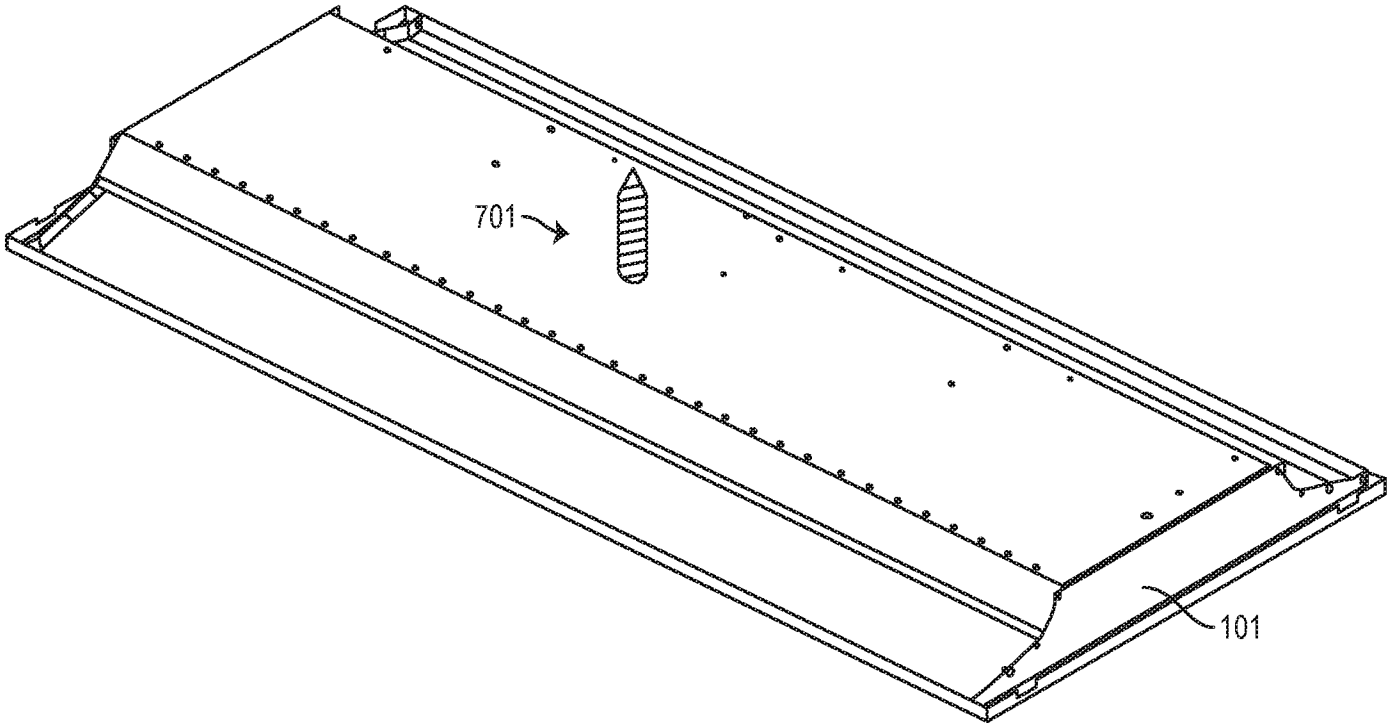
FIG. 7A is an illustration of a troffer door assembly including a screw system for mounting to an existing troffer housing according to an exemplary embodiment.

Referring now to FIG. 7A, door assembly 101 includes screw system 701 in some embodiments. Screw system 701 is a system including at least one screw portion which may be used to mount door assembly 101 to existing troffer light fixture 207 and/or troffer housing 209 thereof. In some embodiments, door assembly 101 includes a single screw system 701 and/or screw system 701 includes only one screw portion. In other words, door assembly 101 is mounted using only a single attachment point. Advantageously, this may reduce the time needed to retrofit existing troffer light fixtures 207 using troffer door retrofit system 100. In various alternative embodiments, door assembly 101 includes a plurality of screw systems 701 and/or screw system 701 includes a plurality of screw portions. The plurality of screw systems 701 and/or screw portions can be arranged in various configurations in various embodiments. For example, door assembly 101 can include a screw portions or screw system 701 at the four corners of door assembly 101. Further configurations are possible such as two screw systems 701 spaced along a centerline of door assembly 101, three screw systems 701 spaced along a centerline of door assembly 101, screw systems 701 otherwise positioned on or through top portion 311, screw systems 701 positioned on or through upper side frame 309 and/or lower side frame 307, and/or one or more screw systems 701 otherwise positioned on or through door assembly 101.

In one embodiment, door assembly 101 is secured to existing troffer light fixture 207 by screwing screw system 701 through door assembly 101 and into existing troffer light fixture 207 (e.g., troffer housing 209). Screw system 701 may pass through a hole in door assembly 101 with a diameter that allows screw threads but not a screw head and/or washer to pass through. Alternatively, screw system 701 can penetrate door assembly 101 (e.g., top portion 311) during the installation process.

Lens 305 of door assembly 101 may be removable to provide access for screwing screw system 701 through door assembly 101 and into troffer housing 209 and/or another component of existing troffer light fixture 207. Prior to screwing screw system 701 through door assembly 101 and into existing troffer light fixture 207, one or more components of existing troffer light fixture 207 may be removed as described with reference to FIG. 5. This may provide space for door assembly 101 within troffer housing 209. In alternative embodiments, door assembly 101 may be secured within existing troffer light fixture 207 without the removal of components. For example, a lens of existing troffer light fixture 207 may be opened, door assembly 101 may be inserted and secured using screw system 701, and the lens closed. In alternative embodiments, screw system 701 attached door assembly 101 to T-bars 201 and/or other portion of a ceiling system rather than to existing troffer light fixture 207. In further alternative embodiments, screw system 701 is not screwed through a portion of door assembly 101.

Figure 7B:
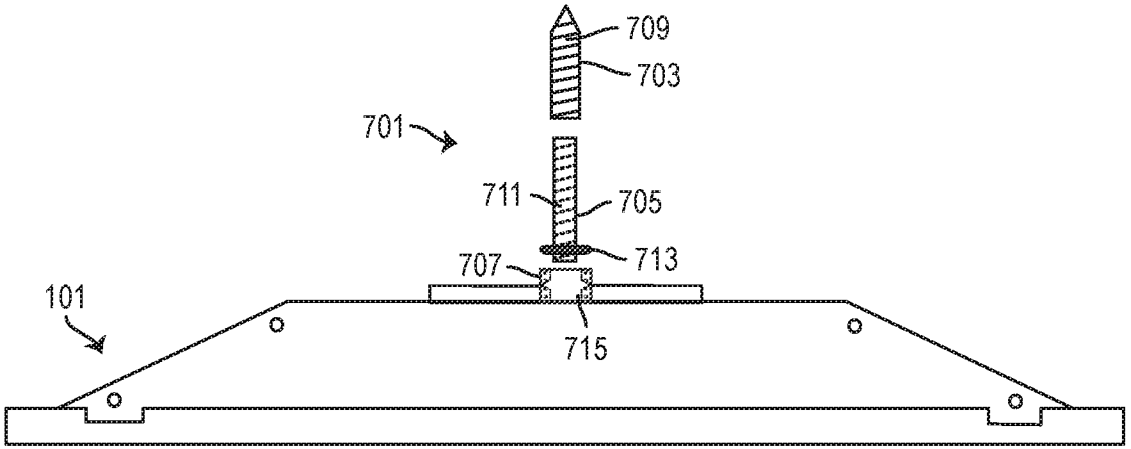
FIG. 7B is a side view illustration of a troffer door assembly including a screw system for mounting to an existing troffer housing according to an exemplary embodiment.

Referring now to FIG. 7B, screw system 701 is illustrated according to one embodiment. Screw system 701 includes screw portion 703, sleeve 705, and receiver 707. In one embodiment, screw portion 703 is screwed into troffer housing 209 of existing light fixtures 207. In alternative embodiments, screw portion 703 is screwed into other portion of existing troffer light fixture 207, T-bars 201, and/or other components in a ceiling system. Screw portion 703 includes threads 709. Threads 709 can assist in screwing screw portion 703 into another component (e.g., troffer housing 209). Screw portion 703 functions as an anchor so screw system 701 and door assembly 101 are hung.

Sleeve 705 is configured to attach to screw portion 703. Sleeve 705 includes threads 711 which are on an internal surface of sleeve 705. Sleeve 705 is hollow which allows sleeve 705 to be screwed onto screw portion 703. Threads 709 of screw portion 703 and threads 711 of sleeve 705 engage with each other. Advantageously, this allows the total height of screw system 701 to be adjusted. The height may be decreased by screwing sleeve 711 further onto screw portion 703. An installer or user can screw portion 703 into a receiving component (e.g., troffer housing 209). The installer or user can then thread sleeve 705 onto screw portion 703 to a depth where door assembly 101 will be flush to the ceiling system (e.g., ceiling tiles and/or troffer housing 209) when connected to screw system 701. The installer or user can make adjustments as desired by threading sleeve 705 on or off screw portion 703.

Door assembly 101 is attached to screw system 701 using sleeve 705 and receiver 707. Sleeve 705 can include protrusion 713. Receiver 707 can include receptacle 715. Door assembly 101 and receiver 707 can be pushed onto sleeve 705 such that protrusion 713 enters receiver 707 and is secured by receptacle 715. Protrusion 713 can be made of a plastically deformable material (e.g., plastic, rubber, or other material). Protrusion 713 is compressed while entering the narrower mouth of receiver 707 and expands to fill the wider region formed by receptacle 715. This removably secures receiver 707 and door assembly 101 to screw system 701 which is in turn mounted to troffer housing 209 and/or other components in a ceiling system. Door assembly 101 can be removed from screw system 701 (e.g., sleeve 705) by pulling with sufficient force that protrusion 713 deforms and exits receiver 707. Screw system 701 can be adjusted (e.g., sleeve 705 moved up or down by threading or unthreading it from screw portion 703) and door assembly 101 can be reattached to screw system 701 using sleeve 705 and receiver 707. In alternative embodiments, other systems, devices, and/or components are used to attach door assembly 101 to screw system 701 or a portion thereof.

Screw system 701 advantageously allows for door assembly 101 to be mounted to existing troffer light fixtures 207, components thereof, and/or other portions of a ceiling system without screwing through door assembly 101. Additionally, screw system 701 allows for door assembly 101 to be removably mounted to existing troffer light fixtures 207, components thereof, and/or other portions of a ceiling system.

Figure 7C:
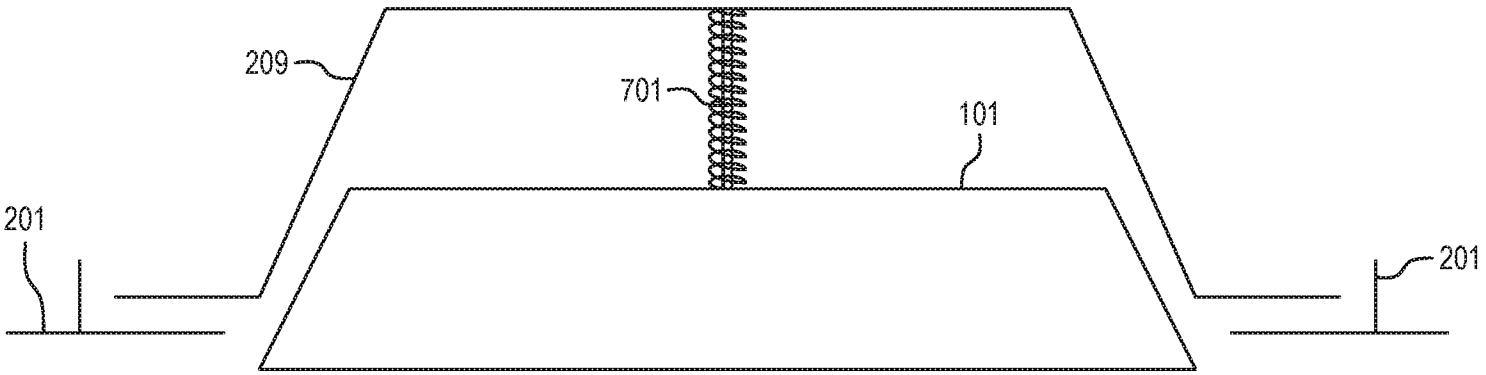
FIG. 7C is a schematic illustration showing the relationship between a troffer door assembly having a screw system and an existing troffer housing according to an exemplary embodiment.

Referring now to FIG. 7C, door assembly 101 and screw system 701 are illustrated in relationship to troffer housing 209 of existing troffer light fixture 207 according to one embodiment. Screw system 701 can mount or otherwise attach door assembly 101 to troffer housing 209. Door assembly 101 can be screwed flush with troffer housing 209 and/or T-bars 201. Alternatively, screw system 701 can be adjusted such that when door assembly 101 is attached to screw system 701 (e.g., using sleeve 705 and receiver 707), door assembly 101 is flush with or nearly flush with troffer housing 209 and/or T-bars 201.

Figure 8A:
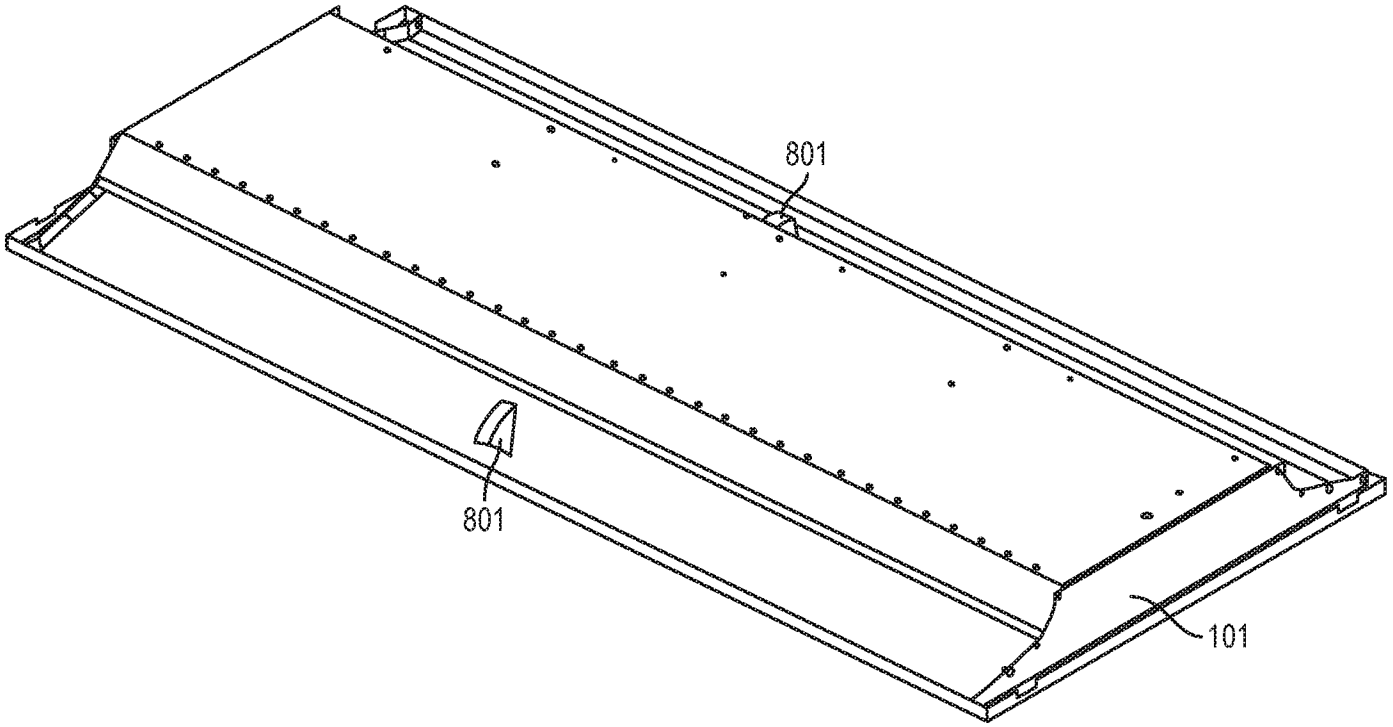
FIG. 8A is an illustration of a troffer door assembly including a pressure fit system for mounting to an existing troffer housing according to an exemplary embodiment.

Referring now to FIG. 8A, door assembly 101 includes pressure fit system 801 in some embodiments. Pressure fit system 801 is a system which secures door assembly 101 against troffer housing 209 of an existing troffer light fixture. Pressure fit system 801 presses against troffer housing 209 keeping door assembly 101 positioned with troffer housing 209 using the resulting friction force. In some embodiments, door assembly 101 includes a single pressure fit system 801. In further embodiments, door assembly 101 includes a plurality of pressure fit systems 801. For example, door assembly 101 can include a pressure fit system 801 on each side located at the midpoint of door assembly 101. In one embodiment, door assembly 101 includes four pressure fit systems 801, one located at each corner or near each corner of door assembly 101.

In one embodiment, pressure fit system 801 is a tab or other protrusion which is plastically or otherwise deformable. As door assembly 101 is inserted into troffer housing 209, pressure fit system 801 contacts troffer housing 209 and deforms. The contact between pressure fit system 801 and troffer housing 209 supports door assembly 101 using the resulting friction force. In alternative embodiments, pressure fit system 801 includes one or more components which secure pressure fit system 801 against troffer housing 209.

Figure 8B:
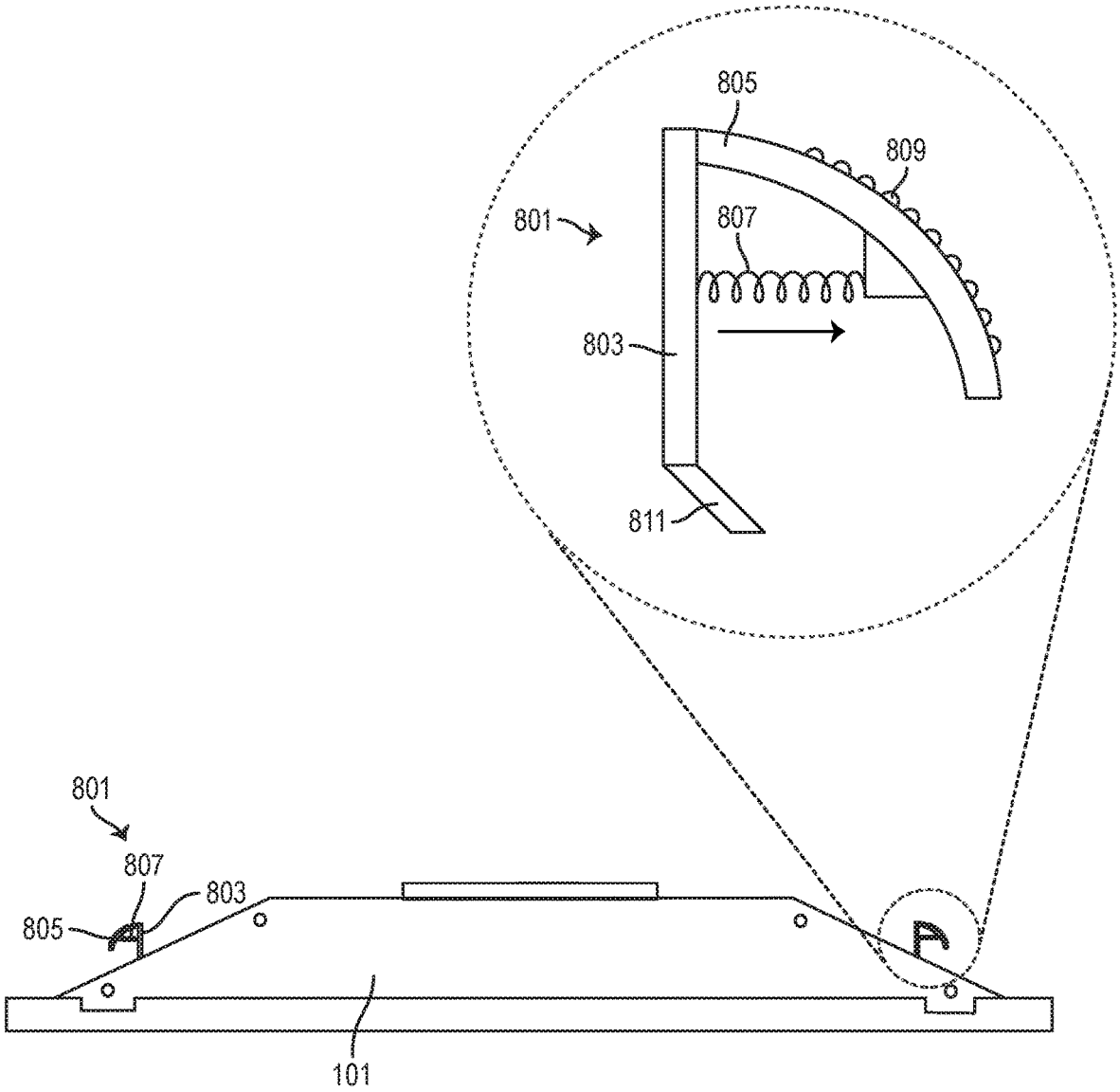
FIG. 8B is a side view illustration of a troffer door assembly including a pressure fit system for mounting to an existing troffer housing according to an exemplary embodiment.

Referring now to FIG. 8B, pressure fit system 801 is spring loaded in some embodiments. Pressure fit system 801 can include a resilient member, shown as spring 807, support 803, friction plate 805, and/or other components. Spring 807 pushes friction plate 805 away from support 803 and into contact with troffer housing 209. As door assembly 101 is placed further within troffer housing 209, friction plate 805 is pushed towards support 803 and spring 807 compresses. Spring 807 provides force against friction plate 805 keeping friction plate 805 in contact with troffer housing 209 and generating friction force which secures door assembly 101.

In some embodiments, friction plate 805 is fixedly attached to support 803. For example, friction plate 805 may be welded to support 803. In further embodiments, friction plate 805 and support 803 may form a single component. For example, a single component including friction plate 805 and support 803 may be cast, milled, and/or injection molded. Advantageously, the shape of support 803 and friction plate 805 may be configured to function as an additional spring mechanism. For example, friction plate 805 may slope away from support 803 such that it springs towards its original position when compressed against troffer housing 209. Friction plate 805 and/or support 803 may be constructed of a material which is plastically deformable allowing friction plate 805 and/or support 803 to function as a spring as described herein. For example, support 803, friction plate 805, and/or other components of pressure fit system 801 may be or include one or more of metals (e.g., aluminum, steel, alloys, and/or other metals), plastics, and/or other plastically deformable materials. In some embodiments, pressure fit system 801 does not include spring 807.

In alternative embodiments, friction plate 805 is attached to support 803 with some degree of motion possible. For example, friction plate 805 may be attached to support 803 using a hinge. In further embodiments, friction plate 805 may be bolted to support 803 such that friction plate 805 can pivot on the bolt towards and/or away from door assembly 101.

In some embodiments, spring 807 provides friction force by pushing friction plate 805 away from support 803 and door assembly 101 and into contact with troffer housing 209. Spring 807 may be permanently attached to one or more of support 803 and friction plate 807. For example, spring 807 may be welded or glued to support 803 and/or friction plate 807. In other embodiments, spring 807 may be secured in place by its own geometry. For example, support 803 and/or friction plate 805 may include one or more receiving structures such as a hollow cylinder which encompass or receive one end of spring 807. The resistance to compression of spring 807 may keep spring 807 inserted into the one or more receiving structures keeping spring 807 in place.

In one embodiment, spring 807 is a coil spring. In various other embodiments, spring 807 is various other types of springs. For example, spring 807 may be a leaf, torsion, or other type of spring. In still further embodiments, spring 807 may be a plastically deformable material placed between support 803 and friction plate 805. For example, spring 807 may be a piece of rubber or plastic placed between support 803 and friction plate 805 configured to provide resistive force when compressed.

In some embodiment, friction plate 805 includes friction material 809. Friction material 809 may be any material with a high coefficient of friction. For example, friction material 809 may be rubber, friction tape, or other material or geometry for gripping troffer housing 209. Friction material 809 may be coupled to friction plate 805 using one or more techniques or substances such as adhesives, sonic welding, etc. In alternative embodiments, friction plate 805 has a geometry or surface roughness which creates a high coefficient of friction.

In some embodiments, pressure fit system 801 includes attachment structure 811. Attachment structure 811 allows for the attachment of pressure fit system 801 to door assembly 101. Attachment structure 811 can be attached to door assembly 101 using techniques and/or hardware such as welding, rivets, nuts and bolts, screws, and/or other coupling systems or methods. In alternative embodiments, pressure fit system 801 is an integral portion of door assembly 101. In some embodiments, support 803 and/or the position of friction plate 805 on support 803 is height adjustable. For example, support 803 may be telescoping with protrusions, an interference fit, and/or other mechanisms which secures or locks the height of support 803. In alternative embodiments, friction plate 805 can be adjusted relative to support 803 to set the height of friction plate 805.

Figure 8C:
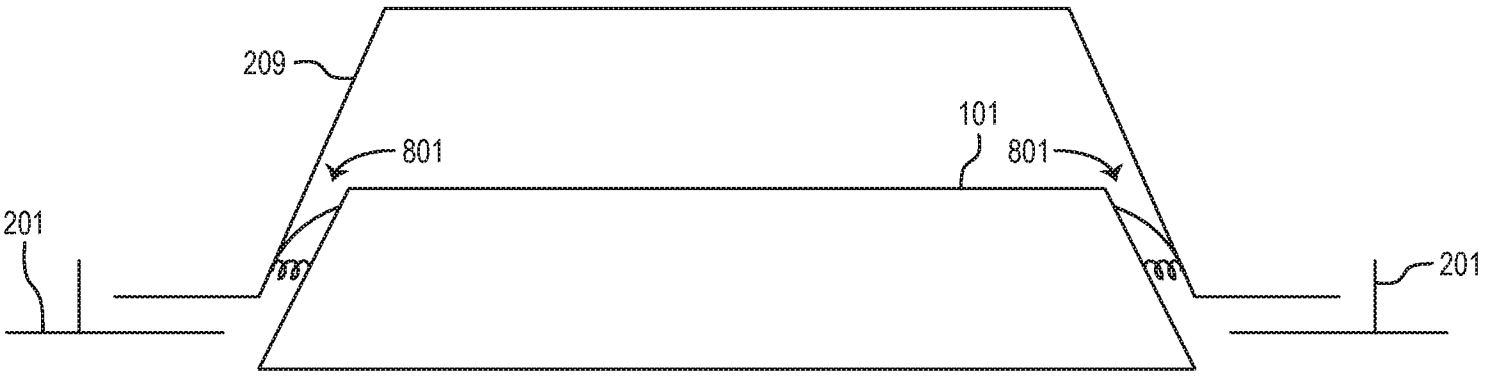
FIG. 8C is a schematic illustration showing the relationship between a troffer door assembly having a pressure fit system and an existing troffer housing according to an exemplary embodiment.

Referring now to FIG. 8C, door assembly 101 and pressure fit system 801 are illustrated in relationship to troffer housing 209 of existing troffer light fixture 207 according to one embodiment. Door assembly 101 is placed within troffer housing 209. As door assembly 101 is inserted further into troffer housing 209, pressure fit system 801 comes into contact with troffer housing 209. Pressure fit system 801 is compressed and generates friction normal force against troffer housing 209. This results in friction force which keeps door assembly 101 suspended within troffer housing 209 against gravity. Pressure fit system 801 may have sufficient play (e.g., spring 807 can be compressed further than is necessary to hold door assembly 101 within troffer housing 209) allowing for door assembly 101 to be placed (e.g., by inserting into troffer housing 209 more or less) flush or nearly flush with troffer housing 209, T-bars 201, and/or other portions of a ceiling system.

Figure 9A:
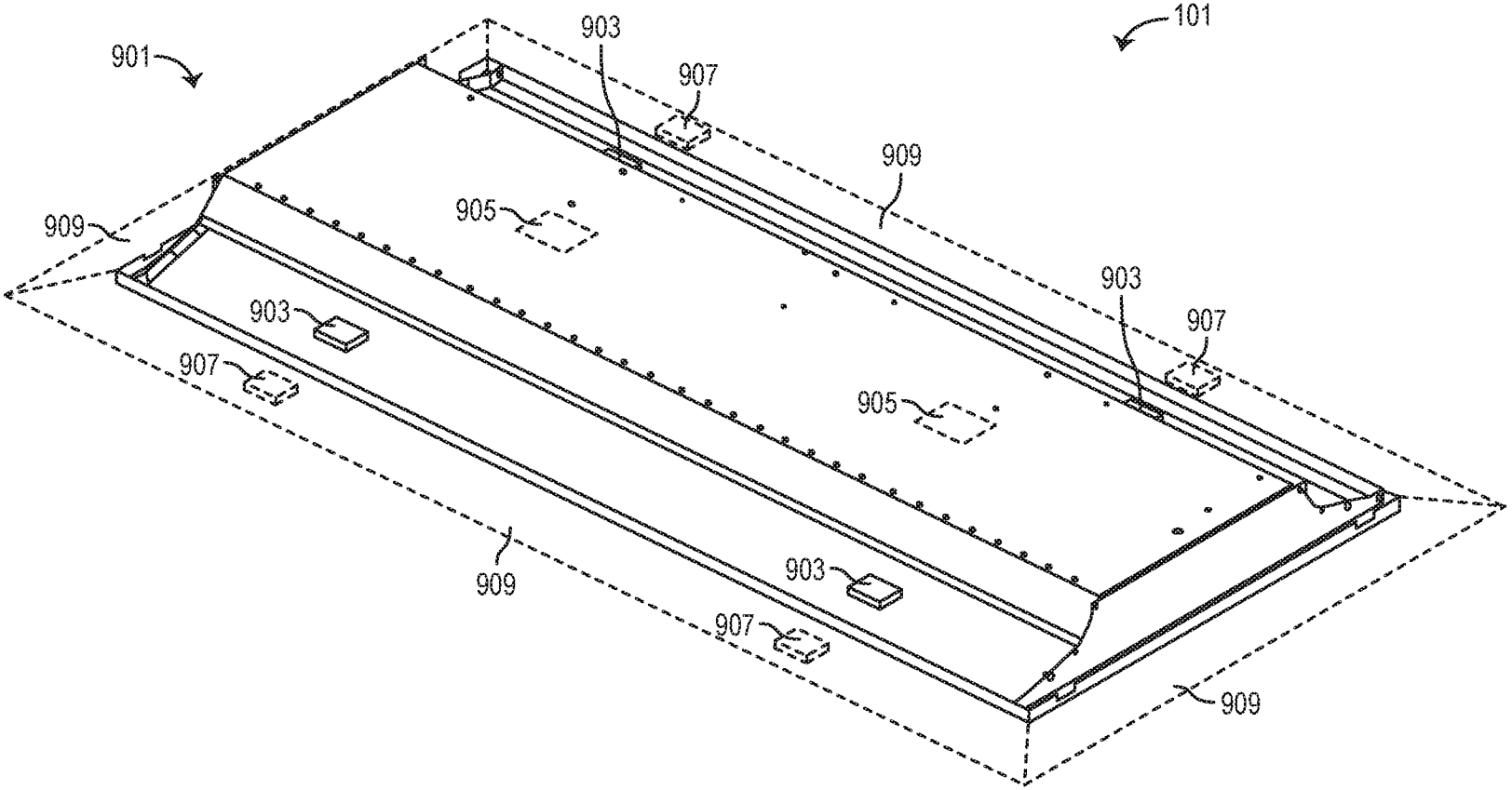
FIG. 9A is an illustration of a troffer door assembly including a magnet fit system for mounting to an existing troffer housing according to an exemplary embodiment.

Referring now to FIG. 9A, door assembly 101 includes magnet system 901 in some embodiments. Magnet system 901 attaches door assembly 101 to one or more of troffer housing 209 of existing troffer light fixture 207, other portions of existing troffer light fixture 207, T-bars 201, magnets or ferromagnetic materials, and/or other portions of a ceiling system. Door assembly 101 can include one or more retainers, shown as magnets 903. In other embodiments, the retainer includes an adhesive (e.g., an adhesive tape, etc.), a snap fit connector, or still another device. Magnets 903 are attached to door assembly 101 in one or more locations. Magnets 903 can be attached to or included in door assembly 101 using one or more techniques. For example, magnets 903 can be attached with adhesive or an enclosure. Magnets 903 can be any permanent magnet. Magnets 903 can hold door assembly 101 in place using magnetic force between magnets 903 and troffer housing 209 and/or T-bars 201. In some embodiments, troffer housing 209 and/or T-bars 201 are not made of a ferromagnetic material. In those cases, an additional permanent magnet or ferromagnetic material (e.g., a strip of magnetic metal) can be attached to or placed on troffer housing 209 and/or T-bars 201. For example, an additional magnet for each magnet 903 (forming magnet pairs) or ferromagnetic material (e.g., a strip of magnetic metal) can be attached to troffer housing 209 using adhesive in locations corresponding to magnets 903 of magnet system 901.

In one embodiment, magnets 903 are included at each corner of door assembly 101. In other embodiments, magnet system 901 has a different number of magnets 903 and/or magnets 903 at other locations on door assembly 101. For example, magnets 903 may be located on one or more of lower side frame 307, upper side frame 309, top portion 311, and/or other locations. In one embodiment, magnets 903 are located on top portion 311 at locations 905. In still further embodiments, door assembly includes flange 909. Flange 909 extends from door assembly 101. In some embodiments, flange 909 is or functions as trim as explained in greater detail with reference to FIGS. 12A-12E. Flange 909 can include magnets 903 at locations 907 and/or other locations. Advantageously, flange 909 can overlap partially or completely with T-bars 201 (e.g., when functioning as trim) allowing magnets 903 at locations 907 and/or elsewhere on flange 909 to support door assembly 101 using magnetic force between magnets 903 and T-bars 201.

Figure 9B:
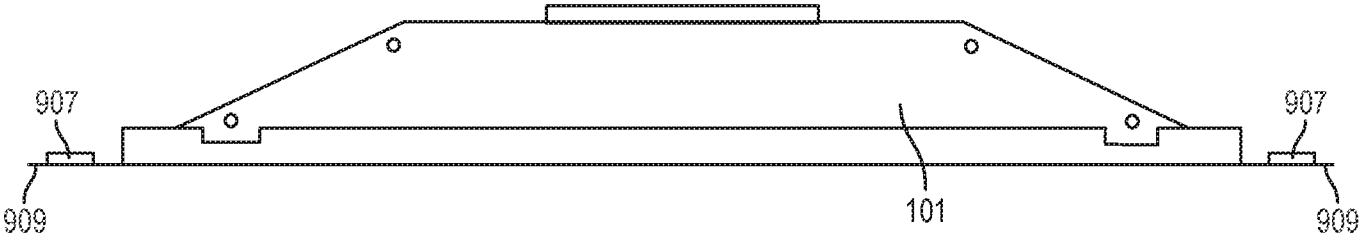
FIG. 9B is a side view illustration of a troffer door assembly including a magnet fit system for mounting to an existing troffer housing according to an exemplary embodiment.

Referring now to FIG. 9B, a side view of door assembly 101 including flange 909 and magnets 903 at locations 907 is illustrated according to an exemplary embodiment. Flanges 909 can be mounted to or form an integral part of door assembly 101. Flanges 909 can position magnets 903 at locations 907 such that magnets 903 contact or are in proximity to T-bars 201. Magnets 903 can be located in other positions.

Figure 9C:
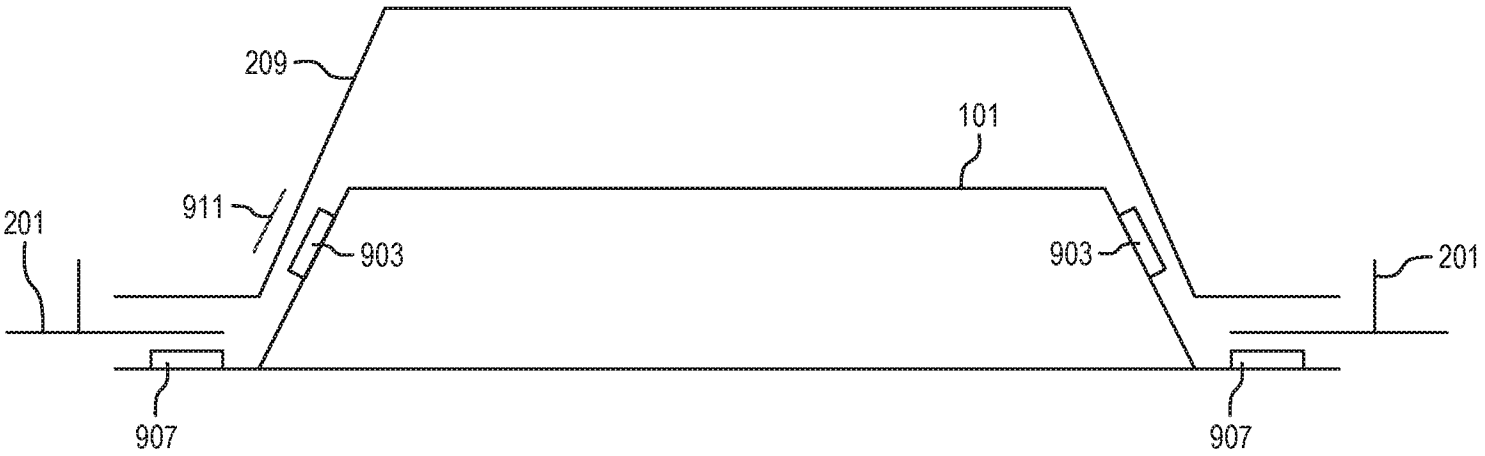
FIG. 9C is a schematic illustration showing the relationship between a troffer door assembly having a magnet fit system and an existing troffer housing according to an exemplary embodiment.

Referring now to FIG. 9C, door assembly 101 and magnet system 901 are illustrated in relationship to troffer housing 209 and T-bars 201 according to one embodiment. In some embodiments, magnets 903 are located on one or more sides of door assembly 101. Magnets 903 contact a side of troffer housing 209 when door assembly 101 is inserted into troffer housing 209. When in close proximity to or in contact with a magnetic troffer housing 209 or a second magnet or ferromagnetic material attached to troffer housing 209, magnets 903 secure door assembly 101 to troffer housing 209.

In alternative embodiments, magnets 903 are located in locations 907 on flanges 909. This positions magnets 903 below T-bars 201. When in close proximity to or in contact with a magnetic T-bar 201 or a second magnet or ferromagnetic material attached to T-bar 201, magnets 903 secure door assembly 101 to T-bar 201. In further alternative embodiments, magnets 903 can be located at one or more of the locations described herein. For example, magnets 903 can be located on the side of door assembly 101 as well as in portions 907.

Figure 10A:
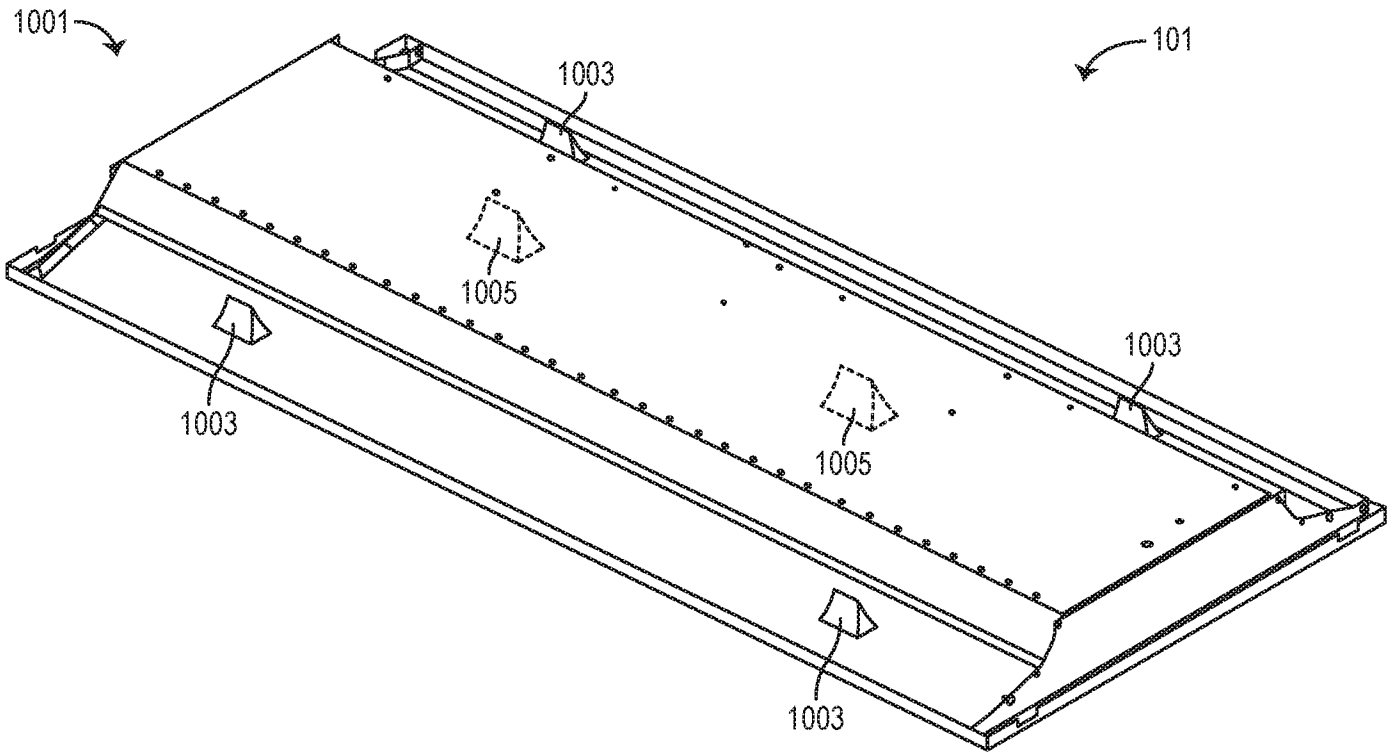
FIG. 10A is an illustration of a troffer door assembly including a biting teeth fit system for mounting to an existing troffer housing according to an exemplary embodiment.

Referring now to FIG. 10A, door assembly 101 includes biting fit teeth system 1001. Biting fit teeth system 1001 includes one or more biting teeth 1003. Biting teeth 1003 are configured to puncture troffer housing 209 of existing troffer light fixture 207, other portions of existing troffer light fixture 207, and/or other portions of a ceiling system. Once punctured, biting teeth 1003 engage with troffer housing 209 of existing troffer light fixture 207, other portions of existing troffer light fixture 207, and/or other portions of a ceiling system to secure door assembly 101 in place. A user or installer can insert door assembly 101 with sufficient force such that biting teeth 1003 puncture troffer housing 209 of existing troffer light fixture 207, other portions of existing troffer light fixture 207, and/or other portions of a ceiling system.

In various embodiments, biting teeth 1003 are located in various locations in or on door assembly 101. In one embodiment, biting teeth 1003 are located at the four corners of door assembly 101. In alternative embodiments, biting teeth 1003 are located at positions 1005 on top portion 311 of door assembly 101. Various numbers of biting teeth 1003 can be located at various locations of door assembly 101 in alternative embodiments.

Figure 10B:
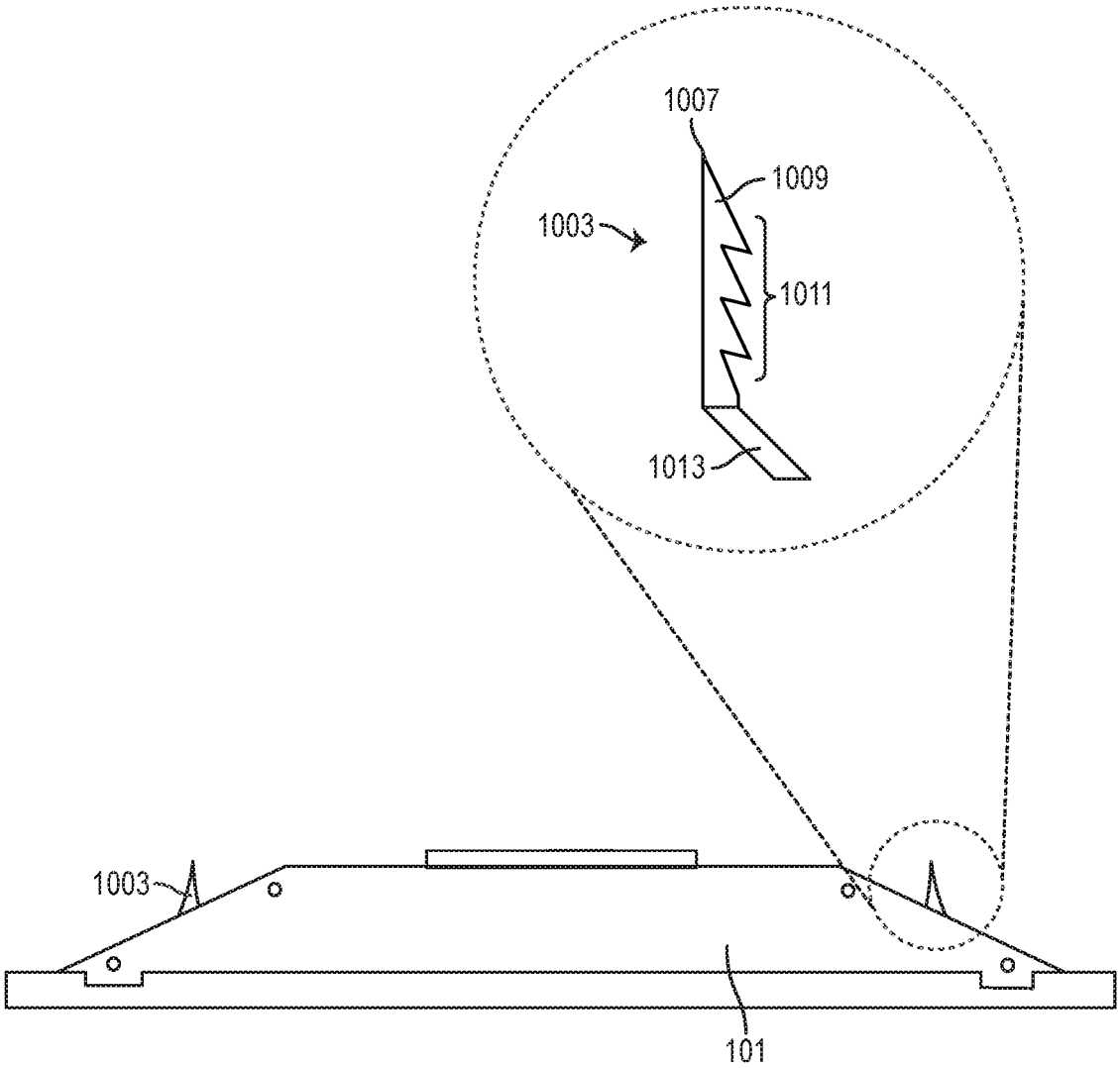
FIG. 10B is a side view illustration of a troffer door assembly including a biting teeth fit system for mounting to an existing troffer housing according to an exemplary embodiment.

Referring now to FIG. 10B, a side view of door assembly 101 including biting teeth 1003 is illustrated according to one embodiment. Biting teeth 1003 of biting fit teeth system 1001 are any shape or configuration which punctures troffer housing 209 or another portion of existing troffer light fixture 207 or a ceiling system. Biting teeth 1003 also hold door assembly 101 in place after having punctured the supporting structure (e.g., troffer housing 209). Biting teeth 1003 can support door assembly 101 using one or more of friction force generated between biting teeth 1003 and the support structure, interference between biting teeth 1003 and the support structure, and/or other mechanisms.

In one embodiment, biting teeth 1003 include one or more of point 1007, edge 1009, notches 1011, and/or attachment structure 1013. Point 1007 may be a partial or complete reduction in the cross section of biting teeth 1003. Point 1007 assists in puncturing the support structure with biting teeth 1003. Point 1007 may reduce the force applied by a user or installer to insert and secure door assembly 101 using biting fit teeth system 1001.

Biting teeth 1003 may include one or more edges 1009. Edges 1009 can be sharpened portions, serrated portions, or portions otherwise configured for cutting. Edges 1009 may reduce the force applied to puncture the support structure (e.g., troffer housing 209). Edges 1009 and/or other portions of biting teeth 1003 can include notches 1011. Notches 1011 prevent biting teeth 1003 from becoming disengaged from the support structure (e.g., troffer housing 209). One or more notches 1011 can be inserted through the support structure as biting teeth 1003 puncture the support structure. Notches 1011 then interfere with the support structure to prevent biting teeth from disengaging with the support structure.

In some embodiments, biting teeth 1003 include attachment structure 1013. Attachment structure 1013 allows for the attachment of biting teeth 1003 to door assembly 101. Attachment structure 1013 can be attached to door assembly 101 using techniques and/or hardware such as welding, rivets, nuts and bolts, screws, and/or other coupling systems or methods. In alternative embodiments, biting teeth 1003 are an integral portion of door assembly 101.

Figure 10C:
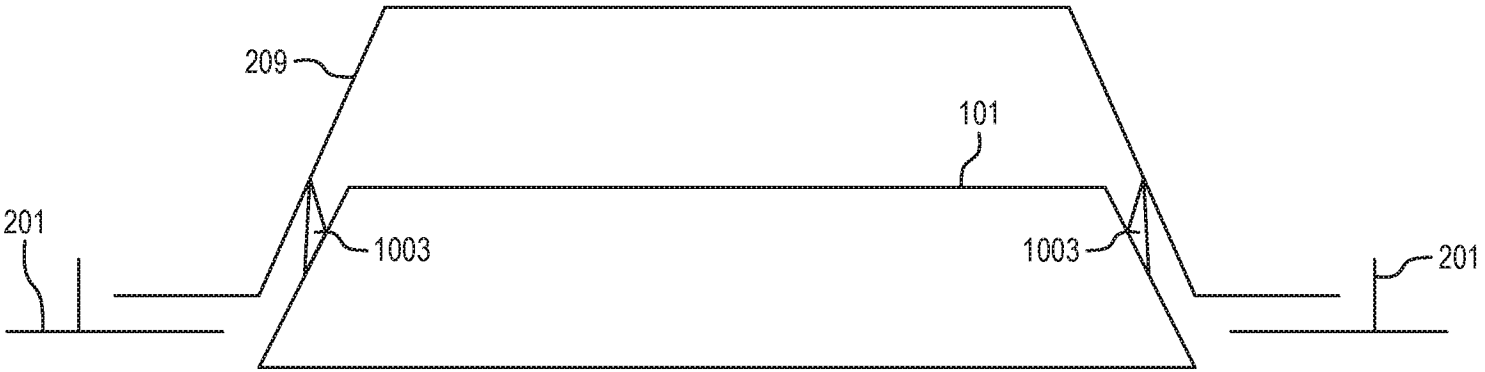
FIG. 10C is a schematic illustration showing the relationship between a troffer door assembly having a biting teeth fit system and an existing troffer housing according to an exemplary embodiment.

Referring now to FIG. 10C, door assembly 101 and biting teeth 1003 are illustrated in relationship with troffer housing 209 and T-bars 201 according to one embodiment. As door assembly 101 is inserted into troffer housing 209, biting teeth 1003 come into contact with and puncture troffer housing 209. Biting teeth 1003 then secure door assembly 101 to troffer housing 209. For example, notches 1011 prevent door assembly 101 from being separated from troffer housing 209 due to gravity. In alternative embodiments, teeth 1003 engage with other portions of existing troffer light fixture 207, T-bars 201, and/or other parts of a ceiling system.

Figure 11A:
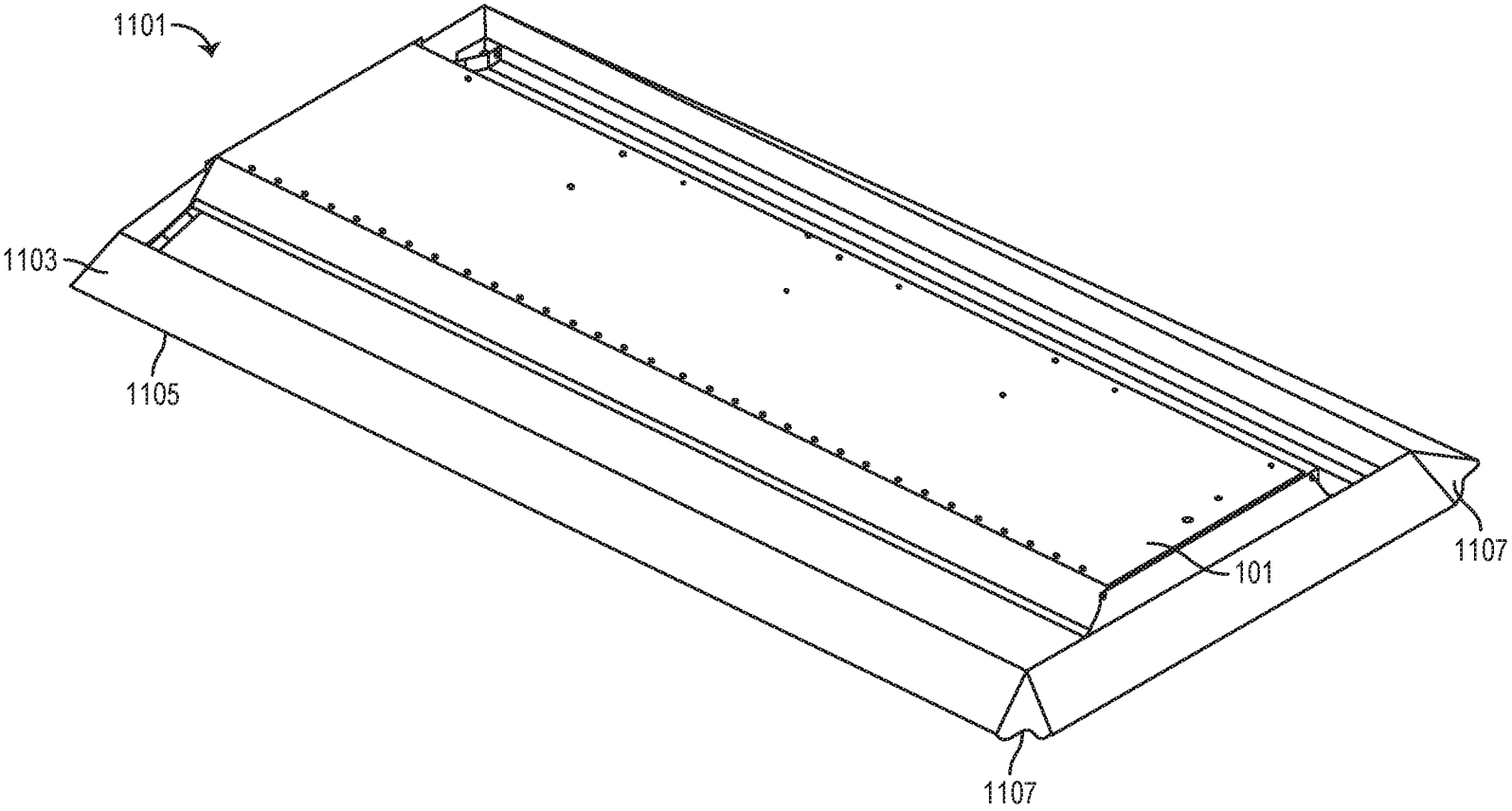
FIG. 11A is an illustration of a troffer door assembly including a flange system for fitting the troffer door assembly in a ceiling system according to an exemplary embodiment.

Referring now to FIG. 11A door assembly 101 is illustrated with flange system 1101 according to one embodiment. Flange system 1101 can be used to install door assembly 101 as a retrofit of an existing fixture or as a new installation. Flange system 1101 secures door assembly 101 within a ceiling system by resting on T-bars 201. Flange system 1101 includes flanges 1103 which angle down and away from one or more sides of door assembly 101. Flanges 1103 terminate in edge 1105. Flanges 1103 are plastically deformable and give door assembly 101 a width greater than the separation between T-bars 201. Door assembly 101 can be inserted between T-bars 201 during which flanges 1103 plastically deform inward towards door assembly 101 as they pass between T-bars 201. When flanges 1103 have cleared T-bars 201 they return to their original shape. Edge 1105 of flanges 1103 are now wider that the space between T-bars 201. Edges 1105 rest on T-bars 201 and support door assembly 101.

In alternative embodiments, flanges 1103 and/or edges 1105 are configured to support door assembly 101 against troffer housing 209 of existing troffer light fixture 207 and/or other portions of a ceiling system. Flanges 1103 and edges 1105 can be inserted past features of troffer housing 209 and/or other features while contracting and then expand to support door assembly 101 as described with reference to T-bars 201.

In one embodiment, flange system 1101 includes a flange 1103 on each side of door assembly 101. In alternative embodiments, a subset of the sides of door assembly 101 include flanges 1103. For example, two opposite sides of door assembly 101 can include flanges 1103 with the other sides not including flanges 1103. Flanges 1103 can be attached to door assembly 101. For example, flanges 1103 can be welded, attached with adhesive, attached with fasteners (e.g., screws, nuts and bolts, rivets, and/or other fasteners), and/or otherwise attached to door assembly 101. In alternative embodiments, flanges 1103 are integral part of door assembly 101. For example, flanges 1103 can form a portion of lower side frame 307.

Flanges 1103 have a geometry and/or are made from a material which allows flanges 1103 to plastically deform and support the weight of door assembly 101. Flanges 1103 may have varying cross sections, channels, dimensions, and/or other characteristics in varying embodiments. In some embodiments, flanges 1103 are constructed of the same material as one or more components of door assembly 101. In alternative embodiments, flanges 1103 are constructed of materials different from those of door assembly 101. In one embodiment, flanges 1103 are constructed of a metal. For example, flanges 1103 may be constructed using aluminum, steel, alloys, and/or other metals. In alternative embodiments, flanges 1103 may be constructed using materials such as plastics, polymers, natural materials, and/or other materials.

Flanges 1103 can be connected with flexible portion 1107. Flexible portion 1107 allows flanges 1103 to deform towards door assembly 101 while being inserted without interfering with one another. Flanges 1103 can deform until they are flush with door assembly 101 in some embodiments. Advantageously, when flanges 1103 return to their original shape and/or otherwise expand away from door assembly 101 after being inserted past T-bars 201, flexible portion 1107 expands with flanges 1103. Flexible portion 1107 can function as a skirt. Flexible portions 1107 may be made of a flexible materials such as rubber, a polymer, cloth, plastic, and/or other materials. Flexible portions 1107 may assist in sealing door assembly 101 to T-bars 201 and/or prevent contaminants, water, or other material from entering the ceiling system. Flexible portion 1107 can give the illusion from below that flanges 1103 extend from door assembly 101 and completely overlap with T-bars 201 or other supporting structures. This provides an aesthetically pleasing appearance as explained in greater detail with reference to FIGS. 11D-11E. In some embodiments, the undersides of flanges 1103 and/or flexible portions 1107 are painted the same color (e.g., black) which creates the appearance of a ring around door assembly 101 and/or the appearance of door assembly 101 fitting within T-bars 201. However, the main portion of door assembly 101 can be smaller than the opening created by T-bars 201. This can allow door assembly 101 and/or flanges 1103 to pass through the opening created by T-bars 201 to then rest on top of T-bars 201.

Figure 11B:
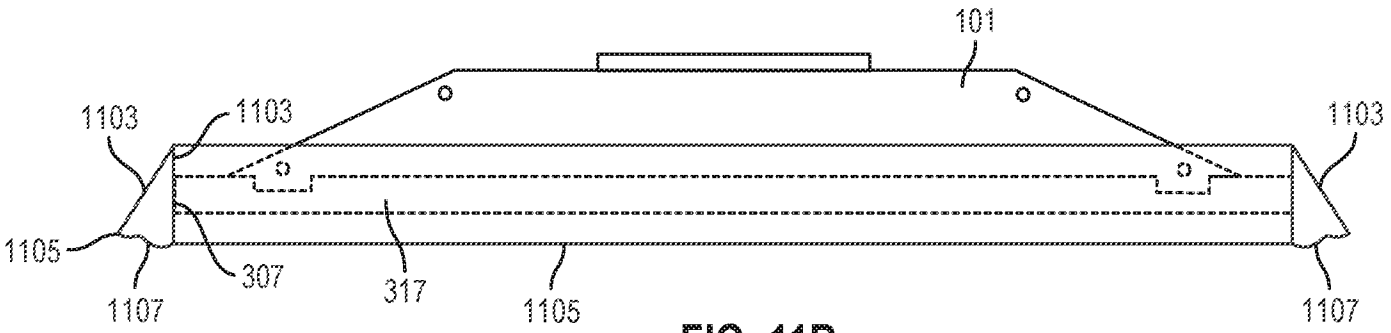
FIG. 11B is a side view illustration of a troffer door assembly including a flange system for mounting the troffer door assembly tin a ceiling system according to an exemplary embodiment.

Referring now to FIG. 11B, a side view of door assembly 101 and flanges 1103 is illustrated according to one embodiment. Flanges 1103 can be attached to lower side frames 309 and/or frame ends 317. Flanges 1103 slope away from door assembly 101. This allows the force of inserting door assembly 101 through the opening formed by T-bars 201 to compress flanges 1103 towards door assembly 101. This geometry can also assist in flanges 1103 functioning as springs (e.g., returning towards their original shape after passing through T-bars 201). Flanges 1103 end in edges 1105 which rest on T-bars 201. Flanges 1103 can be coupled by flexible portions 1107.

Figure 11C:
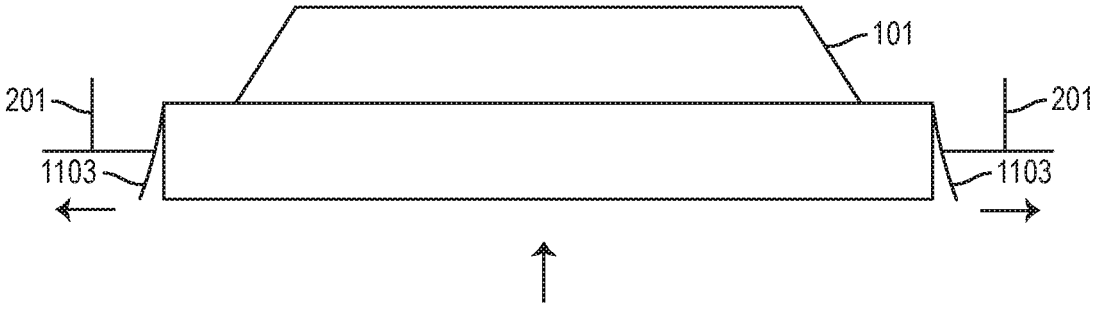
FIG. 11C is a schematic illustration of a troffer door assembly, including a flange system for mounting the troffer door assembly in a ceiling system, as the troffer door assembly is inserted between T-bars of the ceiling system according to an exemplary embodiment.

Referring now to FIG. 11C, door assembly 101 and flanges 1103 are illustrated as they are inserted into a ceiling system through the opening formed by T-bars 201 according to one embodiment. As a user or installer inserts door assembly 101 through the opening, flanges 1103 come into contact with T-bars 201. Flanges 1103 are compressed or plastically deformed towards door assembly 101 and away from T-bars 201. This allows flanges 1103 to fit through the opening formed by T-bars 201.

Figure 11D:
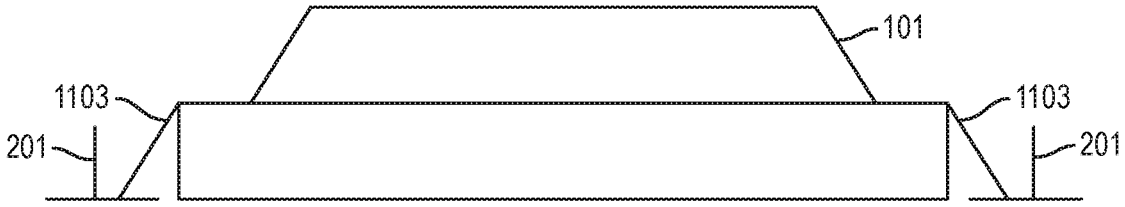
FIG. 11D is a schematic illustration of a troffer door assembly, including a flange system for mounting the troffer door assembly in a ceiling system, with the troffer door assembly inserted between T-bars of the ceiling system according to an exemplary embodiment.

Referring now to FIG. 11D, door assembly 101 and flanges 1103 are illustrated after having passed through the opening formed by T-bars 201. After passing through the opening formed by T-bars 201, flanges 1103 rebound away from door assembly 101. Flanges 1103 then extend over T-bars 201. This allows flanges 1103 to support the weight of door assembly 101. In some embodiments, flanges 1103 are fully extended and not in contact with the vertical portion of T-bars 201. In alternative embodiments, flanges 1103 are not fully extended and are in contact with the vertical portion of T-bars 201. Flanges 1103 extend a sufficient distance away from door assembly 101 to contact the vertical positions of T-bars 201 when door assembly 101 is inserted into the ceiling system. Advantageously, flanges 1103 then exert a force against T-bars 201 which may center door assembly 101 over the opening formed by T-bars 201. The bottom of door assembly 101 (e.g., lens 305) may not extend to T-bars 201. In some embodiments, the undersides of flanges 1103 and flexible portion 1107 are painted a color (e.g., black) so that the space between door assembly 101 and T-bars 201 has a uniform appearance surrounding door assembly 101.

Figure 11E:
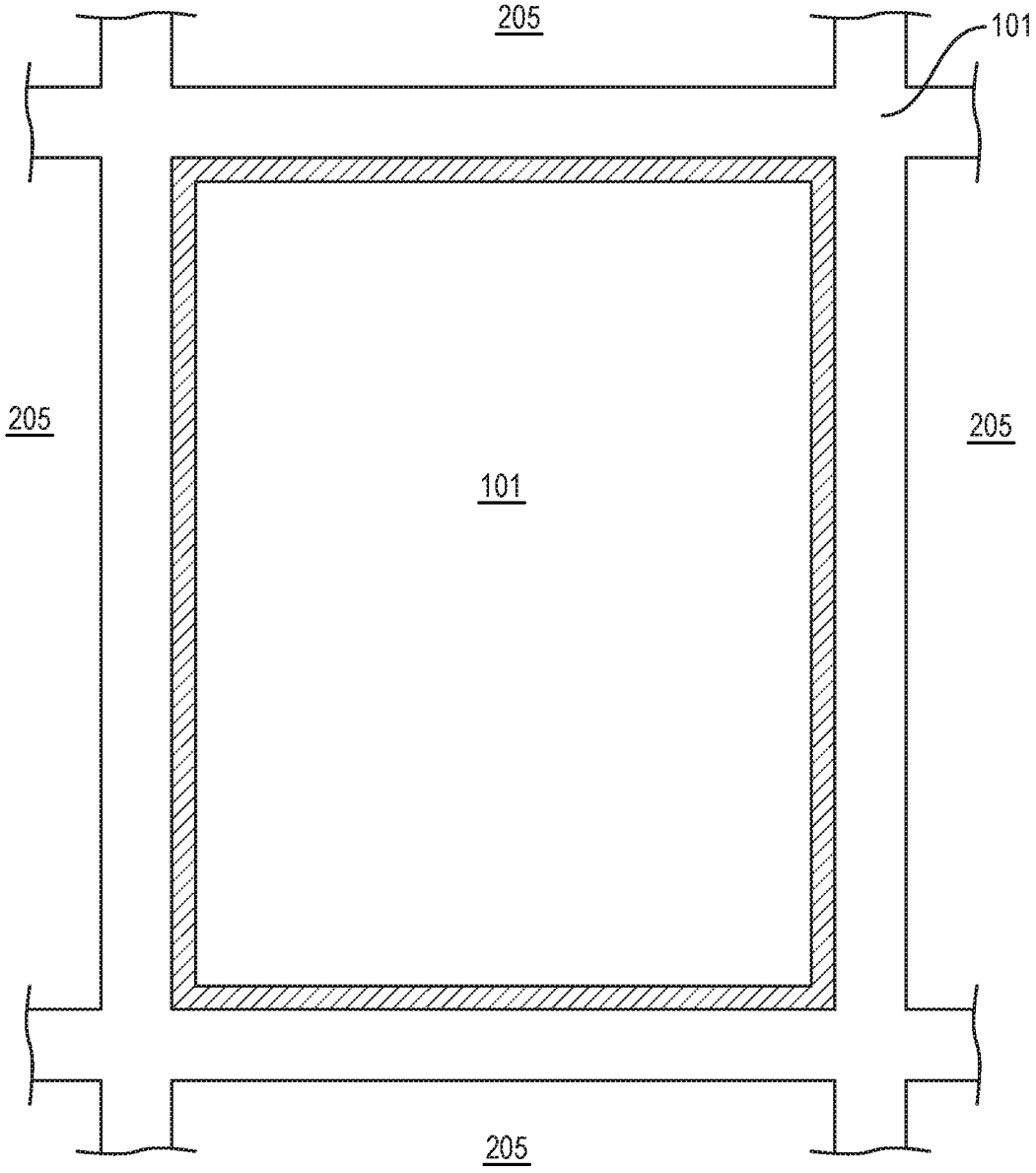
FIG. 11E is a bottom view illustration of a troffer door assembly, including a flange system for mounting the troffer door assembly in a ceiling system, with the troffer door assembly mounted in the ceiling system according to an exemplary embodiment.

Referring now to FIG. 11E, a bottom view of door assembly 101, having flanges 1103, inserted into a ceiling system and resting on T-bars 201 is illustrated according to one embodiment. The space between door assembly 101 and T-bars 201 has a uniform appearance. The painted undersides of flanges 1103 and flexible portions 1107 are visible and give a consistent color and appearance. Door assembly 101 may be centered over the opening by flanges 1103 contacting the vertical portions of T-bars 201. The four corners of door assembly 101 and the opening created by T-bars 201 is covered by flexible portions 1107.

Referring generally to FIGS. 7A-11E, various mounting systems for door assembly 101 are illustrated according to various embodiments. Door assembly 101 can be mounted using one or more of these systems and/or techniques. The described systems and/or techniques can be used in conjunction with methods of installation and/or retrofitting described herein. For example, the systems described with reference to FIGS. 7A-11E can be used in conjunction with one or more of the steps described with reference to FIG. 5. One or more components of existing troffer door light fixture 207 can be removed to provide space for door assembly 101. Door assembly 101 can be wired to a power supply disconnected from existing troffer light fixture 207. Door assembly 101 can then be mounted or otherwise attached to troffer housing 209 of existing troffer light fixture 207, another portion of existing troffer light fixture 207, T-bars 201, and/or other components in a ceiling system using one or more of the systems and/or techniques described in reference to FIGS. 7A-11E Referring now to FIG. 12A, door assembly 101 having trim 1201 is illustrated according to one embodiment. In some embodiments, door assembly 101 includes trim 1201. Trim 1201 overlaps with a portion of T-bars 201. Advantageously, trim 1201 allows troffer door retrofit system 100 to be used in ceiling systems having a variety of T-bars 201. T-bars 201 may have varying widths in varying ceiling systems. T-bars 201 with a narrow width may result in a gap between T-bars 201 and door assembly 101 in cases in which door assembly 101 does not include trim 1201. Trim 1201 extends outward from door assembly 101 and overlaps with T-bars 201 such that trim 1201 allows for the use of troffer door retrofit system 100 with varying T-bars 201 without gaps. Trim 1201 can be included in door assembly 101 for any of the door assemblies 101 described herein. Trim 1201 can be used in conjunction with any one or more securing systems described herein. For example, door assembly 101 can include trim 1201 and be hung using adaptor brackets 103 (and hinges 303 and latches 301) and/or flange system 1101.

In one embodiment, trim 1201 includes panels 1203 extending from door assembly 101. Panels 1203 are included on each side of door assembly 101. In some embodiments, four panels 1203 are attached to door assembly 101. Panels 1203 are configured to meet with one another (e.g., panels 1203 can be mitered). Panels 1203 can be attached to door assembly 101 (e.g., at lower side frames 307 and frame ends 317) using one or more techniques and/or hardware such as welding, rivets, nuts and bolts, screws, and/or other techniques. In alternative embodiments, trim 1201 is made of a single panel 1203 which surrounds door assembly 101. In still further embodiments, panel(s) 1203 are an integral part of door assembly 101. For example, panel 1203 may be a portion of each lower side frame 307 and frame end 317 such that when lower side frames 307 and frame ends 317 are joined, trim 1201 is created.

Figure 12A:
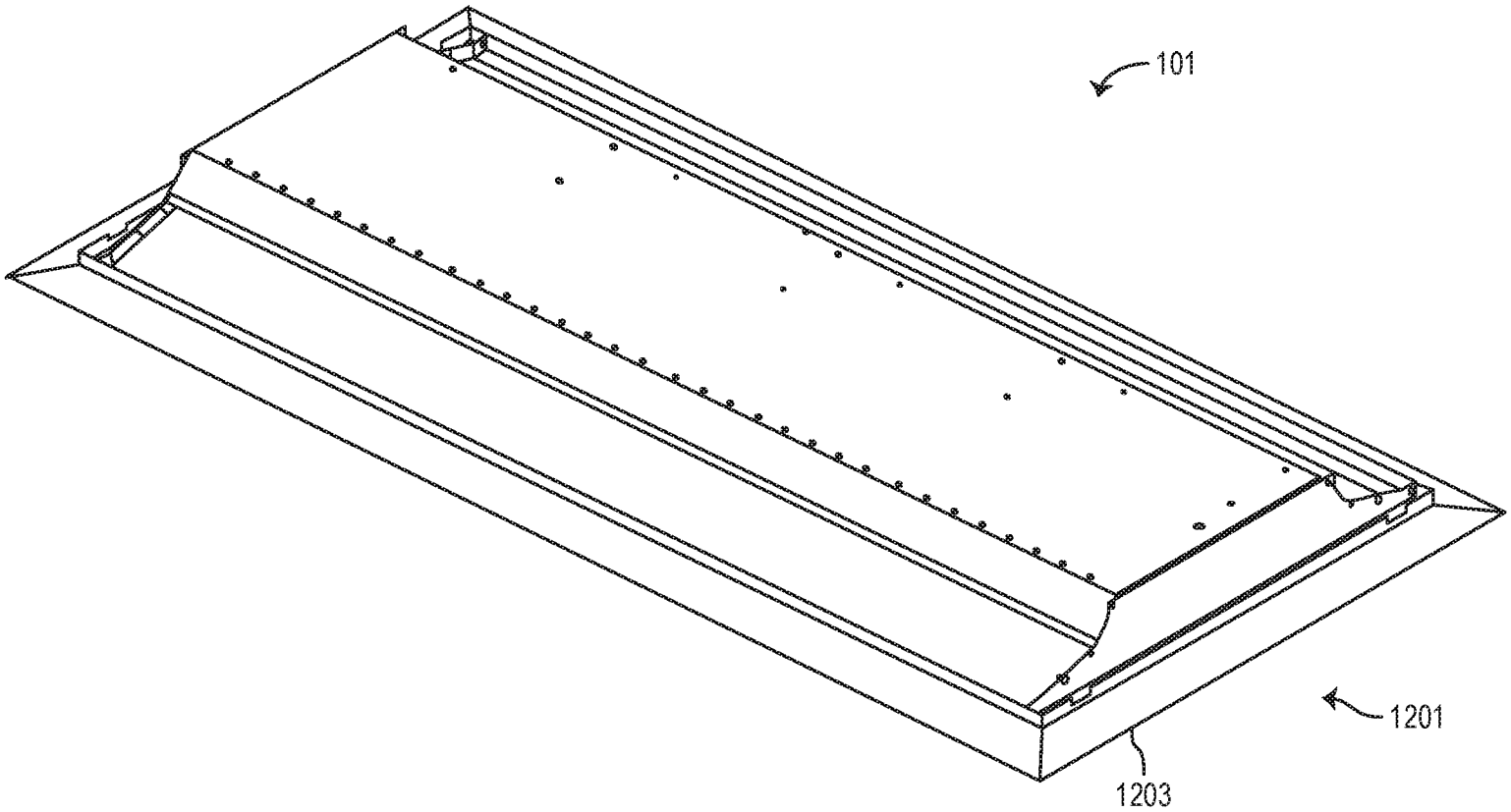
FIG. 12A is an illustration of a troffer door assembly including trim according to an exemplary embodiment.
Figure 12B:
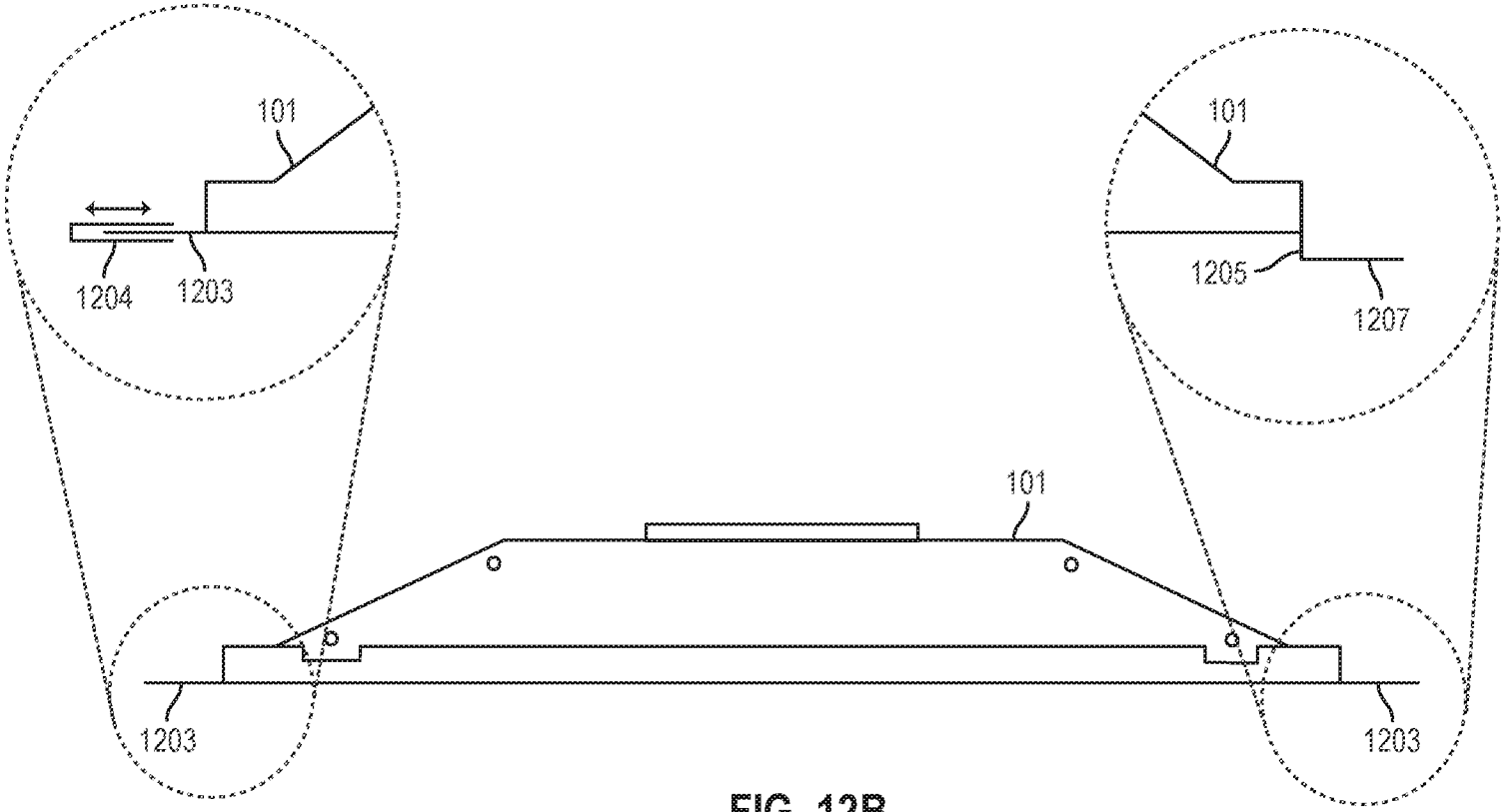
FIG. 12B is a side view illustration of a troffer door assembly including trim according to an exemplary embodiment.

Referring now to FIG. 12B, a side view of door assembly 101 and trim 1201 is illustrated according to one embodiment. In one embodiment, panels 1203 are single sheets extending from door assembly 101 to overlap with T-bars 201. In some embodiments, trim 1201 and panels 1203 are flexible. This allows trim 1201 to be used in conjunction with a troffer door retrofit system 100 including adaptor bracket 103. Door assembly 101 can be hung from adaptor bracket 103 and trim 1201 (e.g., panels 1203) can flex allowing door assembly 101 to hang vertically. When door assembly 101 is latched closed, trim 1201 (e.g., panels 1203) can return to their original shape and be parallel with door assembly 101 and/or T-bars 201. Trim 1201 including panels 1203 may be made of a flexible material such as a polymer, rubber, plastic, or other material.

In an alternative embodiment, panels 1203 extend both downward and out from door assembly 101. This allows trim 1201 to overlap with T-bars 201 passing under T-bars 201. Panels 1203 can include vertical portion 1205 and horizontal portion 1207.

In some embodiments, trim 1201 is adjustable. Trim 1201 can include panel 1203 and a clasp, shown as sliding portion 1204. Sliding portion 1204 may have a running fit with panel 1203 which allows sliding portion 1204 to be moved away from and/or towards door assembly 101. Advantageously, this allows trim 1201 to be configured by a user or installer to a desired size to fit one T-bar 201 of T-bars 201 of varying widths. Sliding portion 1204 can be kept in the desired location relative to panel 1203 due to friction between sliding portion 1204 and panel 1203, a positioning system such as protrusions on panel 1203 and a receiver of sliding portion 1204, and/or using other techniques. Trim 1201 including sliding portion 1204 can be in the same plane as T-bars 201 such that sliding portion 1204 comes into contact with T-bars 201 when extended. In alternative embodiments, sliding portion 1204 is positioned so as to overlap with T-bars 201.

Figure 12C:
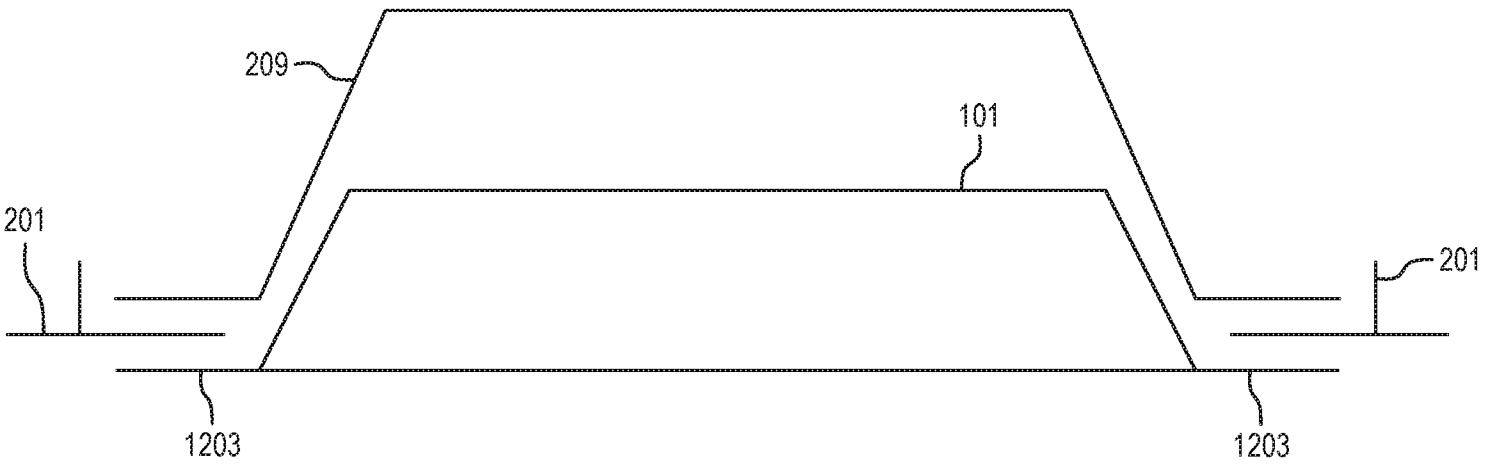
FIG. 12C is a schematic illustration of a troffer door assembly including trim in relation to an existing troffer housing and T-bars of a ceiling system according to an exemplary embodiment.

Referring now to FIG. 12C, door assembly 101 including panels 1203 of trim 1201 is illustrated in relationship to troffer housing 209 of existing troffer light fixture 207 and T-bars 201. Panels 1203 are illustrated overlapping with T-bars 201. Advantageously, this allows for the use of door assembly 101 with T-bars 201 of varying widths without visible gaps.

Figure 12D:
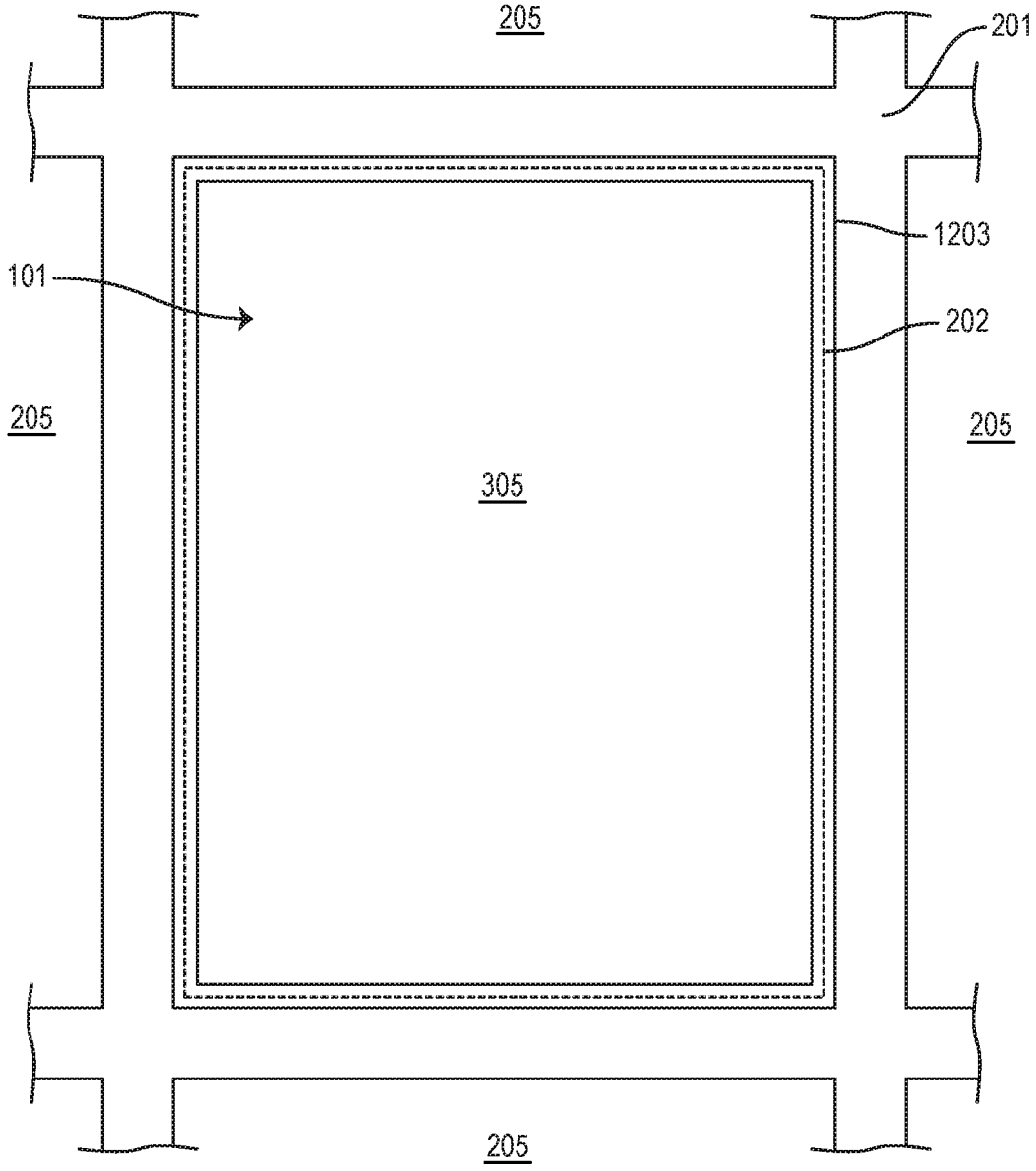
FIG. 12D is a bottom view illustration of a troffer door assembly including trim and mounted in a ceiling system according to an exemplary embodiment.

Referring now to FIG. 12D, a bottom up view of door assembly 101, including panels 1203 of trim 1201, installed in a ceiling system is illustrated according to one embodiment. Panels 1203 overlap with T-bars 201. Inner edge 202 of T-bars 201 is covered by panels 1203. Panels 1203 of trim 1201 prevents gaps between door assembly 101 and T-bars 201 from being visible.

Figure 12E:
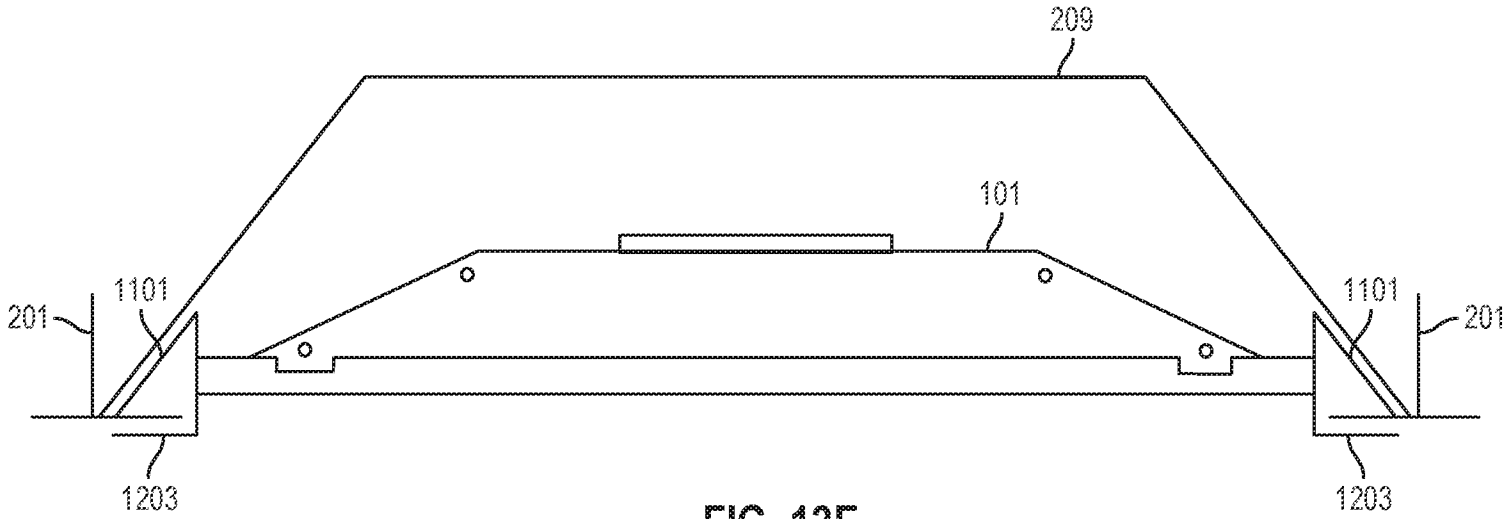
FIG. 12E is a side view illustration of a troffer door assembly including trim and a bracketless mounting system according to an exemplary embodiment.

Referring now to FIG. 12E, trim 1201 can be used in conjunction with any one or more of the securing systems described herein (e.g., adaptor brackets 103, screw system 701, pressure fit system 801, magnet system 901, biting fit teeth system 1001, and/or flange system 1101). In one embodiment, trim 1201 is included in door assembly 101 having flange system 1101. Flange system 1101 along with door assembly 101 is inserted between T-bars 201 such that flange system 1101 supports door assembly 101. Flange system 1101 can be used to support door assembly 101 within troffer housing 209 of existing troffer light fixture 207 or as an original installation rather than a retrofit. Flange system 1101 can push against troffer housing 209 to center door assembly 101. Trim 1201 including panels 1203 can extend from door assembly 101 and overlap with T-bars 201. In various alternative embodiments, trim 1201 is used in conjunction with various other installation techniques and/or systems.

Referring generally to FIGS. 13A-15, door assembly 101 can be an edge lit panel in some embodiments. Door assembly 101, as an edge lit panel, can be used as described previously herein with reference to door assembly 101. Door assembly 101, constructed from or as an edge lit panel, can be used in conjunction with any of the retrofit techniques, installation techniques, installation systems, trim systems, and/or other systems and methods described herein. For example, door assembly 101, constructed from or as an edge lit panel, can include hinges 303 and latches 301 and be used with adaptor brackets 103, can include one or more of screw system 701, pressure fit system 801, magnet system 901, biting fit teeth system 1001, flange system 1101 and/or trim 1201, and/or otherwise be used as door assembly 101 has been described.

Figure 13A:
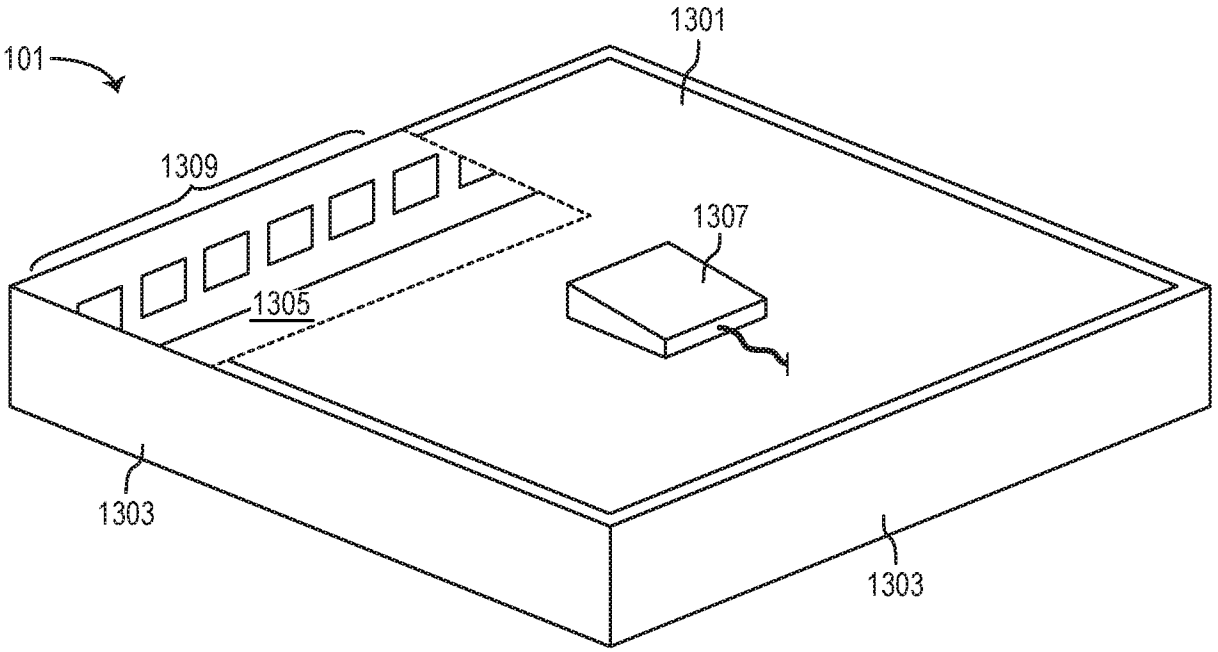
FIG. 13A is an illustration of an edge lit troffer door assembly according to an exemplary embodiment.

Referring now to FIG. 13A, door assembly 101 can include LEDs 1309, periphery panels, shown as edge panels 1303, top panel 1301, electronics enclosure 1307, lens 1305, and/or other components. In alternative embodiments, door assembly 101 includes a subset of these components. For example, door assembly 101 may not include top panel 1301 and/or electronics enclosure 1307.

Edge panels 1303 form a frame of door assembly 101. In one embodiment, four edge panels 1303 are attached to create the frame. Edge panels can be attached using techniques and/or hardware such as welding, rivets, nuts and bolts, screws, and/or other coupling systems or methods. In alternative embodiments, a single panel 1303 forms the frame. A single panel can be formed using techniques such as injection molding, casting, extrusion, stamping, and/or other techniques. Panel(s) 1303 may be constructed of metals (e.g., aluminum, steel, alloys, etc.), plastics, and/or other materials. Lens 1305 and top panel 1301 can enclose the frame made of edge panels 1303. Top panel 1301 can support electronics enclosure 1307. The components can be made and/or attached using similar techniques and/or hardware. LEDs 1309 are attached to one or more vertical portions of panel(s) 1303 such that LEDs 1309 illuminate door assembly 101 and provide light through lens 1305 from the edge of door assembly 101 outward. LEDs 1309 may have primary light axes extending inward into a cavity defined by edge panels 1303. LEDs 1309 may illuminate lens 1305 from behind with a uniform distribution of light when engaged. The position of LEDs 1309 (e.g., disposed around at least a portion of the periphery of the housing, etc.) may provide a low-profile lighting arrangement configured to fit within a space above the ceiling system without jeopardizing light uniformity (e.g., relative to traditional systems involving LEDs coupled to a back panel of a housing and positioned close to a lens, etc.).

Edge lit door assembly 101 can provide one or more advantages over an overhead lit door assembly 101 (e.g., door assembly 101 as described in reference to FIGS. 3A-3C). Edge lit door assembly 101 can be significantly shorter than an overhead lit door assembly 101. This allows edge lit door assembly 101 to be compatible with a wider variety of existing troffer light fixtures 207 including those with shallow troffer housings 209. The short height of edge lit door assembly 101 may reduce or eliminate the need to remove components from existing troffer light fixture 207 prior to installing door assembly 101. Edge lit door assembly 101 may provide further advantages in that less material is used in making edge lit door assembly 101. This can reduce complexity and/or cost of door assembly 101.

Figure 13C:
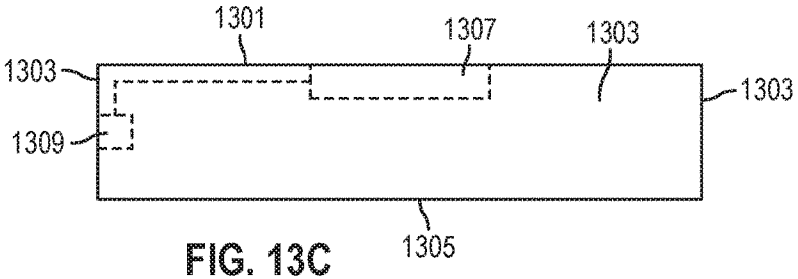
FIG. 13C is a side illustration of an edge lit troffer door assembly having internally stored electronics according to an exemplary embodiment.
Figure 13E:
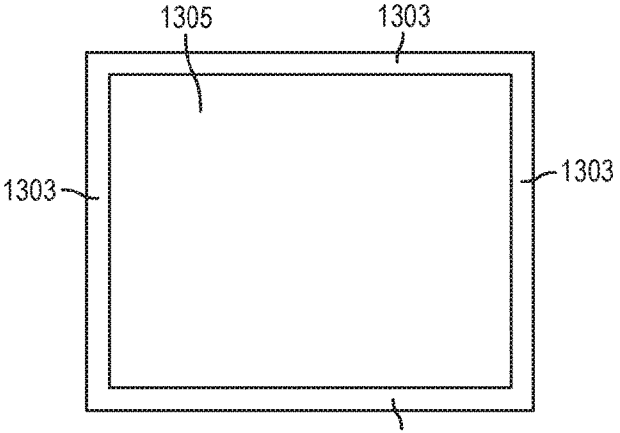
FIG. 13E is a bottom view of an edge lit troffer door assembly having a flat lens according to an exemplary embodiment.
Figure 13B:
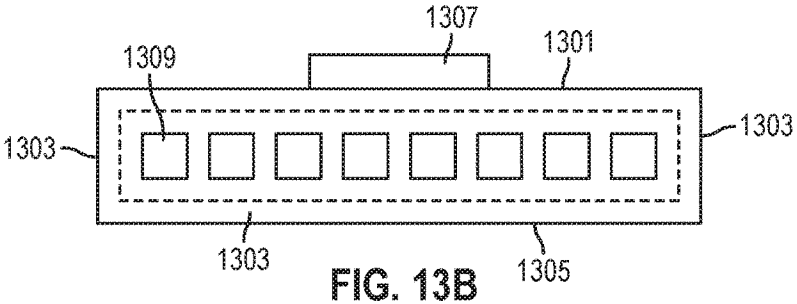
FIG. 13B is a side illustration of an edge lit troffer door assembly according to an exemplary embodiment.

Referring now to FIG. 13B, a side view of edge lit door assembly 101 is illustrated according to one embodiment. LEDs 1309 can extend the length of edge panels 1303. In some embodiments LEDs 1309 run the length of all edge panels 1303. In alternative embodiments, other LED 1309 configurations are used.

Referring now to FIG. 13C, a side view of edge lit door assembly 101 having an internal electronics enclosure 1307 is illustrated according to one embodiment. Electronics enclosure 1307 can be located within edge lit door assembly 101. Electronics enclosure 1307 can be suspended from top panel 1301. Advantageously, this reduces the height of edge lit door assembly 101 which may make door assembly 101 compatible with shallower troffer housings 209 of existing troffer light fixtures 207. Electronics enclosure 1307 includes one or more electronic components. For example, electronics enclosure 1307 can receive power from an external power source at a driver which is connected to and drives LEDs 1309.

Figure 13D:
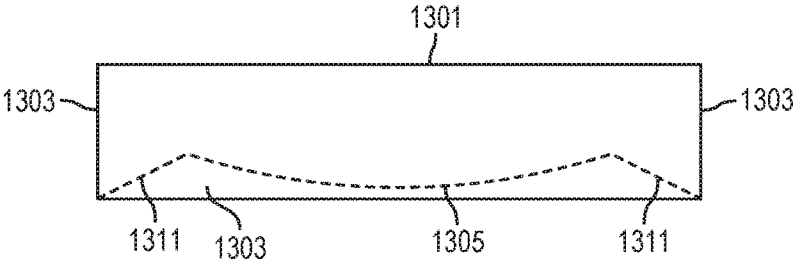
FIG. 13D is a side illustration of an edge lit troffer door assembly having a contour lens according to an exemplary embodiment.

Referring now to FIG. 13D, a side view of edge lit door assembly 101 having a contour lens 1305 is illustrated according to one embodiment. Edge lit door assembly 101 can have a contour lens 1305. Contour lens 1305 can be suspended from edge panels 1303 by lens supports 1311. Contour lens 1305 may provide for better light distribution from edge lit door assembly 101. Contour lens 1305 may further be more aesthetically pleasing than other types of lenses.

Referring now to FIG. 13E, a bottom view of edge lit door assembly 101 is illustrated according to one embodiment. Edge lit door assembly 101 can include a flat lens 1305. Flat lens 1305 may be easier to manufacture, less expensive, give a desired light distribution, and/or otherwise provide advantages. Lens 1305 can be supported by a lip or other protrusion from edge panels 1303 or otherwise be supported and/or attached to edge panels 1303.

Figure 13F:
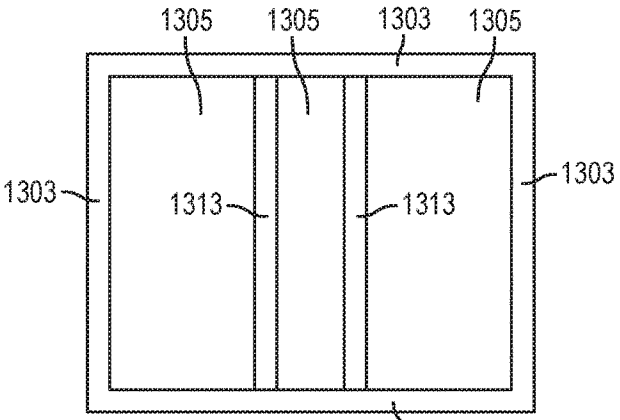
FIG. 13F is a bottom view of an edge lit troffer door assembly having a three part lens according to an exemplary embodiment.

Referring now to FIG. 13F, a bottom view of edge lit door assembly 101 having three lenses 305 is illustrated according to one embodiment. Edge lit door assembly 101 can include three lenses 1305. Lenses 305 can be supported by edge panels 1303 and/or supports 1313. The use of three lenses 1305 may improve the light distribution from edge lit door assembly 101. Three lenses 305 may also give an aesthetically pleasing appearance to door assembly 101.

Figure 13G:
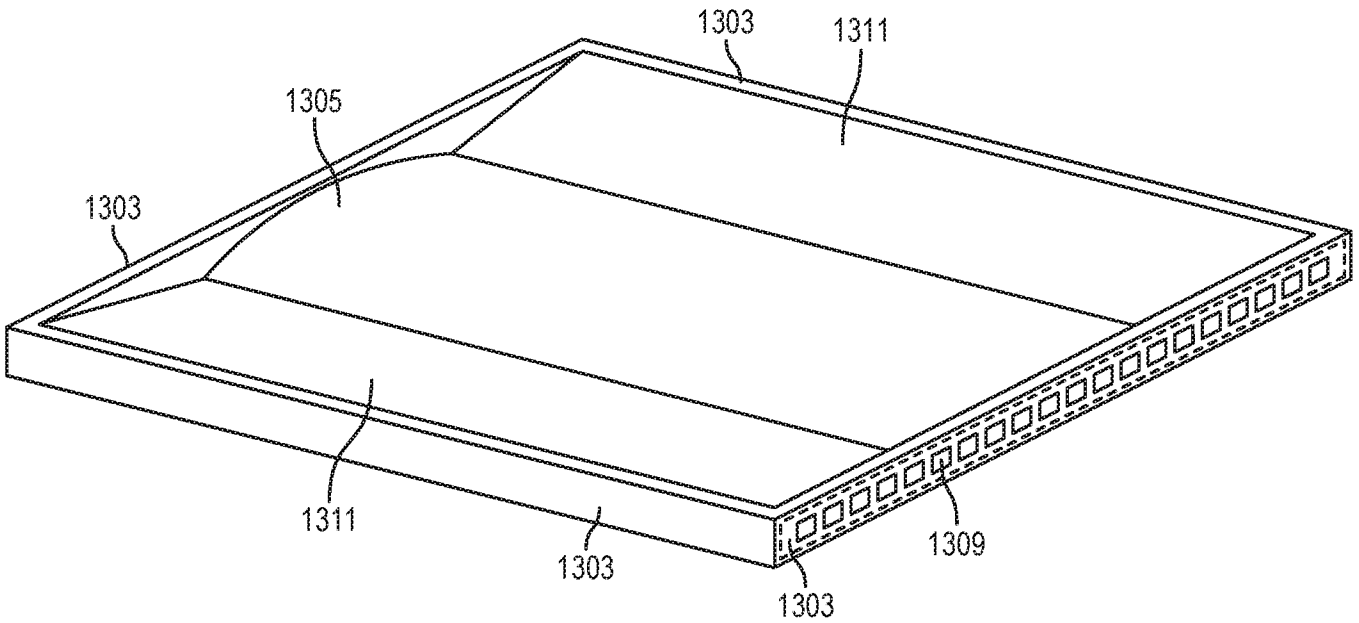
FIG. 13G is a bottom perspective view of an edge lit troffer door assembly having a contour lens according to an exemplary embodiment.

Referring now to FIG. 13G, a bottom perspective view of edge lit door assembly 101 having contour lens 1305 is illustrated according to one embodiment. Contour lens 1305 may improve or otherwise alter the light distribution from edge lit door assembly 101 and LEDs 1309 therein. Contour lens 1305 can be supported by lens supports 1311.

Figure 14A:
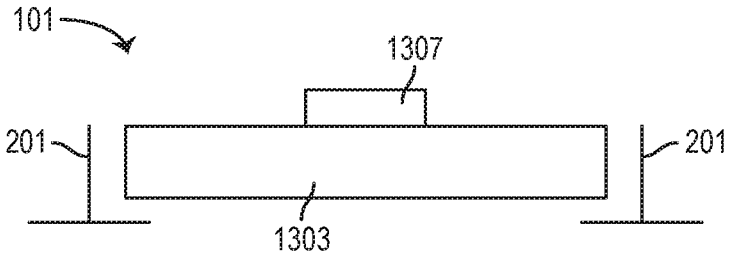
FIG. 14A is a schematic illustration of an edge lit troffer door assembly mounted in a ceiling system according to an exemplary embodiment.

Referring now to FIG. 14A, edge lit door assembly 101 can be used in a new installation of a light fixture. In some embodiments, edge lit door assembly 101 can be installed in a ceiling system by placing edge lit door assembly 101 on T-bars 201. No additional hardware may be needed to support edge lit door assembly 101 in the ceiling system.

Figure 14B:
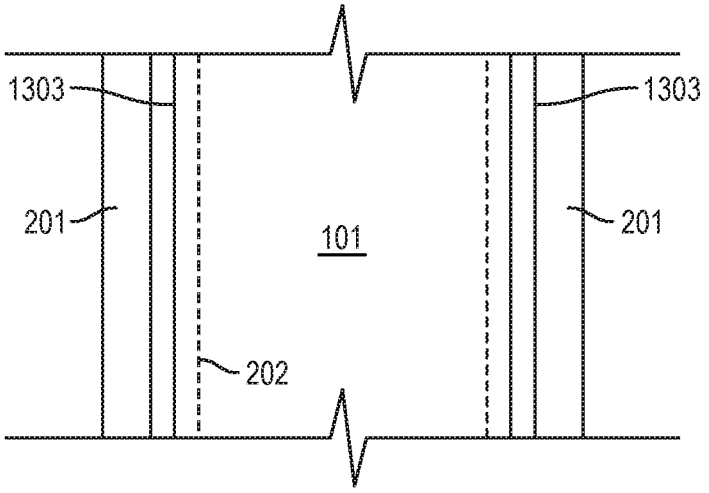
FIG. 14B is a top view of an edge lit troffer door assembly mounted in a ceiling system according to an exemplary embodiment.

Referring now to FIG. 14B, a top down view of edge lit door assembly 101 and T-bars 201 is illustrated according to one embodiment. Edge lit door assembly 101 rests on T-bars 201. Door assembly 101 is larger than the opening created by T-bars 201 such that when door assembly 101 is placed on T-bars 201 from above, door assembly 101 does not pass through the opening formed by T-bars 201. Edge lit door assembly 101 overhangs the edges 202 of T-bars 201.

Figure 14C:
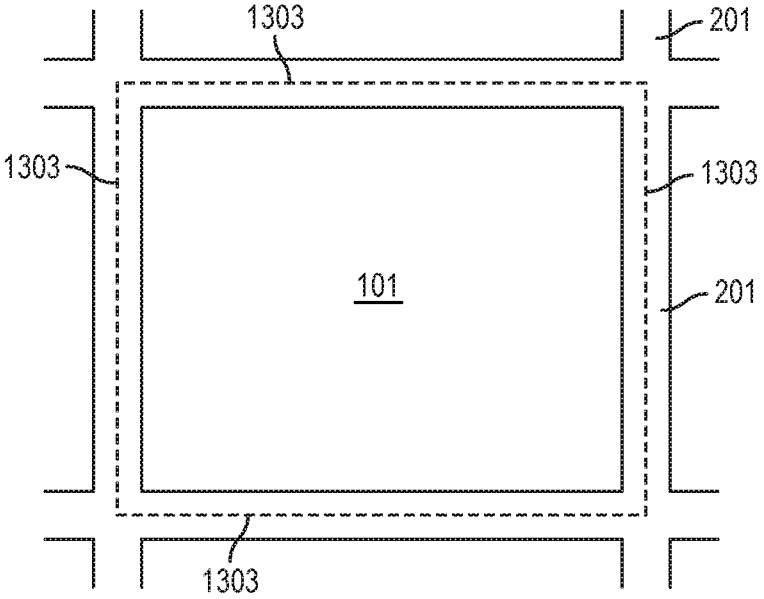
FIG. 14C is a bottom view of an edge lit troffer door assembly mounted in a ceiling system according to an exemplary embodiment.

Referring now to FIG. 14C, a bottom up view of edge lit door assembly 101 and T-bars 201 is illustrated according to one embodiment. There is no visible gap between edge lit door assembly 101 and T-bars 201 as door assembly 101 overhangs T-bars 201. Edge panels 1303 rest on T-bars 201 outside of the opening formed by T-bars 201.

Figure 15:
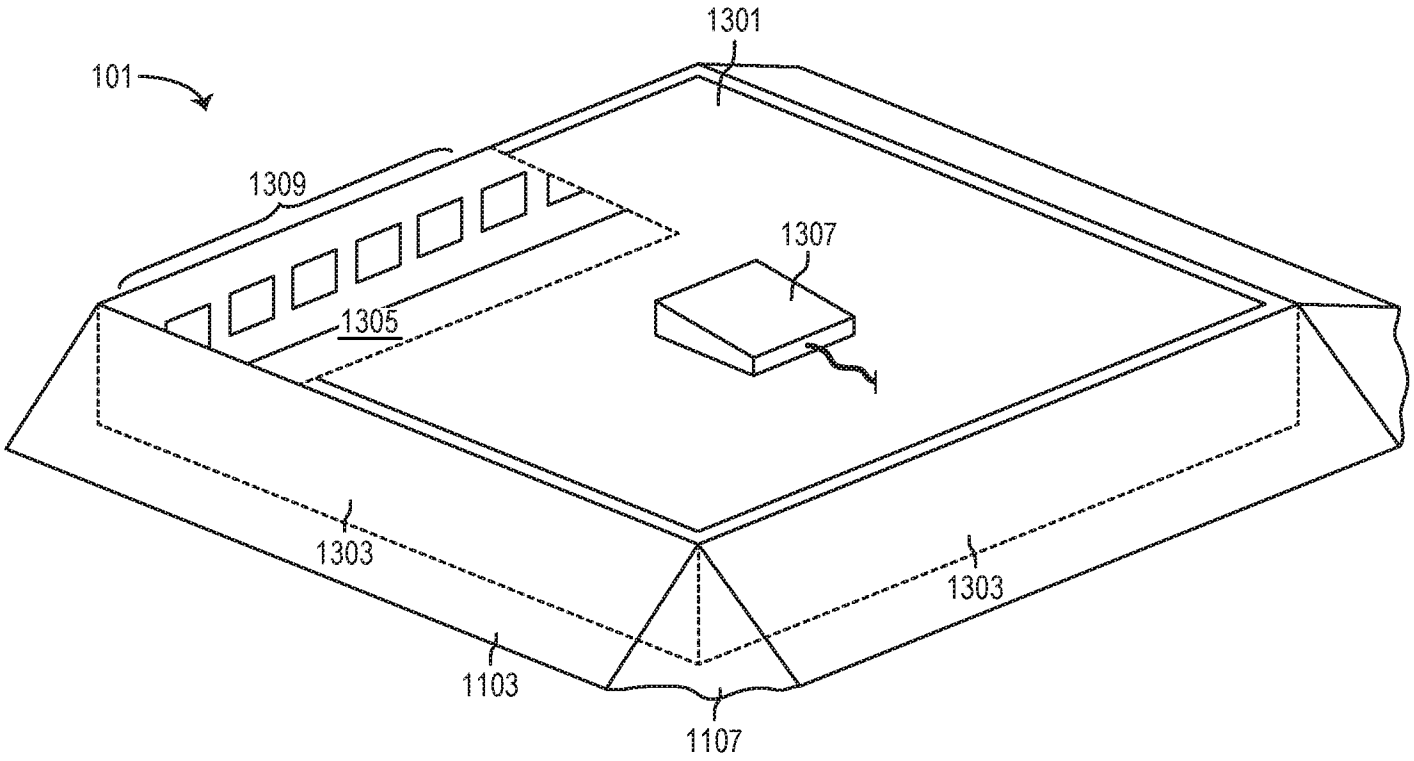
FIG. 15 is an illustration of an edge lit troffer door assembly having a flange system for mounting in a ceiling system according to an exemplary embodiment.

Referring now to FIG. 15, edge lit door assembly 101 having flange system 1101 is illustrated according to one embodiment. Edge lit door assembly 101 can be used in troffer door retrofit system 100 to retrofit an existing troffer light fixture 207 as previously described herein. In retrofit embodiments, the frame formed by edge panel(s) 1303 is smaller than the opening formed by T-bars 201. This allows for edge lit door assembly 101 to pass through T-bars 201 to be secured to troffer housing 209 of existing troffer light fixture 207, another portion of existing troffer light fixture 207, T-bars 201, and/or other portions of a ceiling system. Edge lit door assembly 101 can include can include one or more of screw system 701, pressure fit system 801, magnet system 901, biting fit teeth system 1001, flange system 1101 and/or trim 1201. Flange system 1101 can be attached to or otherwise incorporated in edge panel(s) 1303 of edge lit door assembly 101. Flange system 1101 can operate as previously described with respect to FIGS. 11A-11E to secure edge lit door assembly 101 in a retrofit application.

Figure 16:
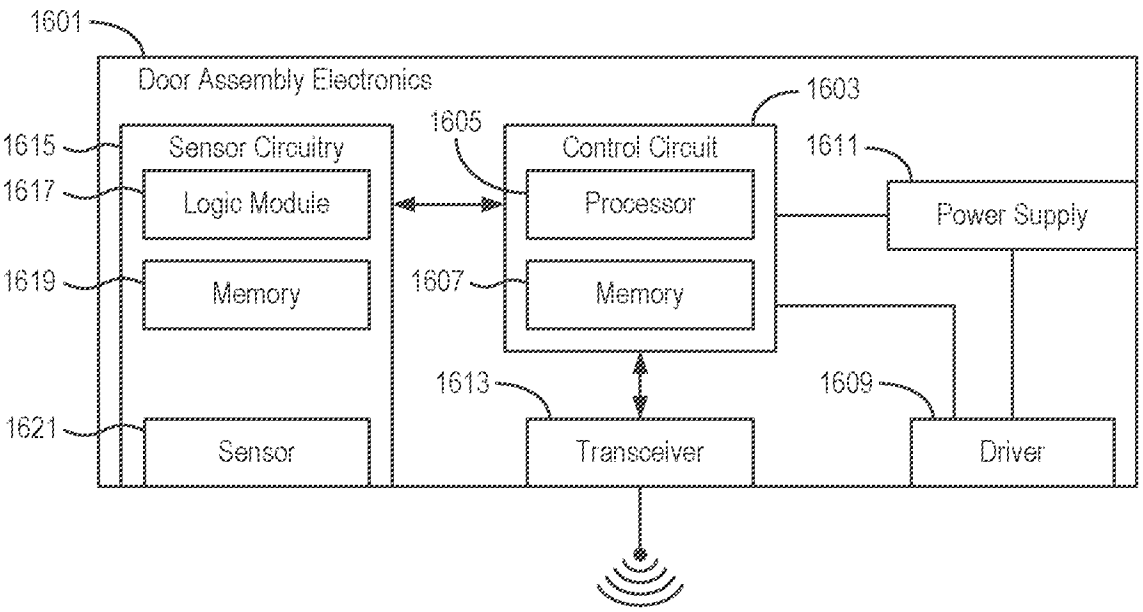
FIG. 16 is a schematic illustration of the electronic components of a troffer door assembly according to an exemplary embodiment.

Referring now to FIG. 16, components of door assembly electronics 1601 are illustrated according to one embodiment. Door assembly 101 can include a various door assembly electronics 1601 in various embodiments. In one embodiments, door assembly electronics 1601 are located within cover 313. In further embodiments, one or more components or portions thereof can be located partially or completely outside of a cover or housing. Door assembly electronics 1601 can control light output of LEDs included in door assembly 101, provide power to LEDs in door assembly 101, and/or perform other functions.

In some embodiments, door assembly electronics 1601 include a power supply 1611. Power supply 1611 can be one or more electrical supply wires which enter cover 313. Power supply 1611 can include further components such as capacitors, modulators, transformers, batteries, and/or other components to regulate, alter, modify, or otherwise provide electrical power to door assembly electronics 1601 and/or LEDs in door assembly 101.

In some embodiments, door assembly electronics 1601 include driver 1609. Driver 1609 can be a driver for driving or otherwise providing power to LEDs within door assembly 101. Driver 1609 may be electrically coupled to one or more LEDs, LED strips, and/or other LEDs through wiring. The wiring may exit cover 313. Driver 1609 can control electrical power supplied to the LEDs using techniques such as pulse width modulation and/or other techniques. Driver 1609, by controlling the supply of electrical power to the LEDs, can control the light output of the LEDs. Driver 1609 can control the intensity of the light output from the LEDs, control the color temperature of light output by the LEDs, dim the LEDs, turn on or off the LEDs, and/or otherwise alter or control the light output from the LEDs. Driver 1609 can be coupled to control circuit 1603. Driver 1609 can be controlled by control circuit 1603.

In some embodiments, door assembly electronics 1601 include control circuit 1603. Control circuit 1603 may contain circuitry, hardware, and/or software for facilitating and/or performing the functions described herein. Control circuit 1603 may handle inputs, process inputs, run programs, handle instructions, route information, control memory 1607, control a processor 1605, process data, generate outputs, communicate with other devices or hardware, and/or otherwise perform general or specific computing tasks. In some embodiments, control circuit 1603 includes a processor 1605 and/or memory 1607. Control circuit 1603 can perform functions such as controlling driver 1609 in response to inputs, receiving inputs from transceiver 1613, receiving inputs locally (e.g., through a user interface, buttons, switches, etc.), receiving inputs from sensor circuitry 1615, controlling sensor circuitry 1615, controlling transceiver 1613 (e.g., sending or receive communications using transceiver 1613), and/or performing other functions related to door assembly 101 and/or other light fixtures or devices.

Processor 1605 may be implemented as a general-purpose processor, an application specific integrated circuit (ASIC), one or more field programmable gate arrays (FPGAs), a digital-signal-processor (DSP), a group of processing components, or other suitable electronic processing components. Memory 1607 is one or more devices (e.g. RAM, ROM, Flash Memory, hard disk storage, etc.) for storing data and/or computer code for facilitating the various processes described herein. Memory 1607 may be or include non-transient volatile memory or non-volatile memory. Memory 1607 may include database components, object code components, script components, or any other type of information structure for supporting various activities and information structures described herein. Memory 1607 may be communicably connected to processor 1605 and provide computer code or instructions to processor 1605 for executing the processes described herein. Memory 1607 and/or the control circuit 1603 may facilitate the functions described herein using one or more programming techniques, data manipulation techniques, and/or processing techniques such as using algorithms, routines, lookup tables, arrays, searching, databases, comparisons, instructions, etc.

In some embodiments, door assembly electronics 1601 include transceiver 1613. Transceiver 1613 may be a wireless transceiver used to send and/or receive wireless communications. For example, transceiver 1613 may be a transceiver which sends and/or receives radio frequency transmissions using protocols and/or hardware related to WiFi, Zigbee, Bluetooth, or other types of communication. In other embodiments, transceiver 1613 uses communication techniques other than the use of radio frequency transmissions. For example, transceiver 1613 may use ultrasound, optical, infrared, and/or other communications techniques. Transceiver 1613 can provide control signals to control circuit 1603. In response to control signals (e.g., sent from a control device such as a mobile phone, computer, remote, or other device), control circuit 1603 can control the light output of door assembly 101 using driver 1609. For example, control circuit 1603 can adjust the light intensity, color temperature, turn on or off LEDs, or otherwise change the light output of door assembly 101 using driver 1609.

In some embodiments, control circuit 1603 can control transceiver 1613 in order to transmit communication signals. Control circuit 1603 can transmit information, using transceiver 1613, related to the functions of door assembly 101, the light output of door assembly 101, and/or sensor information received by sensor circuitry 1615. For example, control circuit 1603 can cause the transmission of information, using transceiver 1613, including diagnostic information, whether door assembly 101 is currently on or off, the light intensity being produced by door assembly 101, whether motion has been detected by sensor circuitry 1615, and/or other information. In some embodiments, transceiver 1613 transmits this and/or other information to mobile phones, computers, remotes, and/or other devices. In further embodiments, transceiver 1613 transmits this information to one or more other door assemblies 101.

In some embodiments, door assembly electronics 1601 includes sensor circuitry 1615. Sensor circuitry 1615 can be controlled by control circuit 1603. Sensor circuitry 1615 can also provide sensor information and/or control signals to control circuit 1603. Sensor circuitry 1615 may include one or more logic modules 1617, memory 1619, and/or sensors 1621. Sensor circuitry 1615 can use these and/or other components to provide door assembly electronics 1601 information regarding the environment in which door assembly 101 operates. For example, sensor circuitry 1615 can detect motion with a motion sensor. In response to detecting motion (e.g., using a motion sensor 1621 and processing the data using memory 1619 and/or logic module 1617), sensor circuitry 1615 can provide the information and/or a control signal to control circuit 1603 which causes control circuit 1603 to take action (e.g., turning on one or more LEDs, adjusting the intensity and/or color temperature of the light output, etc.). As an additional example, sensor circuitry 1615 can determine the intensity or amount of light surrounding door assembly 101. In response to determining the amount or intensity of light (e.g., using a light sensors 1621, memory 1619, a threshold value and/or logic module 1617), sensor circuitry 1615 can provide the information and/or a control signal to control circuit 1603 which causes control circuit 1603 to take action (e.g., adjust the light output using driver 1609 to compensate for low light by increasing the light output, decreasing the light output in response to high levels of ambient light, etc.).

Sensor circuitry 1615 may contain circuitry, hardware, and/or software for facilitating and/or performing the functions described herein. Sensor circuitry 1615 may handle inputs, process inputs, run programs, handle instructions, route information, control memory 1619, control or use a logic module 1617, process data, generate outputs, communicate with other devices or hardware, and/or otherwise perform general or specific computing tasks. Sensor circuitry 1615 can be or include an application specific integrated circuit (ASIC), one or more field programmable gate arrays (FPGAs), a digital-signal-processor (DSP), a group of processing components, or other suitable electronic processing components. Memory 1619 is one or more devices (e.g. RAM, ROM, Flash Memory, hard disk storage, etc.) for storing data and/or computer code for facilitating the various processes described herein. Memory 1619 may be or include non-transient volatile memory or non-volatile memory. Memory 1619 may include database components, object code components, script components, or any other type of information structure for supporting various activities and information structures described herein. Memory 1619 may provide computer code or instructions for executing the processes described herein. Memory 1619 and/or the sensor circuitry 1615 may facilitate the functions described herein using one or more programming techniques, data manipulation techniques, and/or processing techniques such as using algorithms, routines, lookup tables, arrays, searching, databases, comparisons, instructions, etc.

Logic module 1617 may be implemented as hardware and/or software. Logic module 1617 may be stored in or use memory 1619. Logic module 1617 can provide code or instructions for carrying out or facilitating the functions of sensor circuitry 1615 described herein. Alternatively, logic module can carry out these functions directly. Logic module 1617 can be used to perform tasks such as comparing sensor data to threshold values, determining if movement has occurred using a variety of techniques, measuring ambient light, comparing ambient light measurements to threshold values, formatting control signals for control circuit 1603, and/or performing other tasks or functions to facilitate the operation of door assembly 101 as described herein.

In some embodiments, sensor circuitry 1615 includes one or more sensors 1621. Sensors 1621 can be any type of sensor. In one embodiment, sensor 1621 is or includes a motion sensor. For example, sensor 1621 may be or include an infrared motion sensor, ultrasound motion sensor, projected capacitance motion sensor, and/or other type of motion sensor. In other embodiments, sensor 1621 can be or include a light sensor. For example, sensor 1621 may be or include a photodetector, bolometer, photoresister, or other light sensor. In still further embodiments, sensor 1621 can be or include other types of sensors such as temperature sensors, humidity sensors, and/or other sensors. Sensor 1621 may be located partially or wholly outside of cover 313.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products including machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A retrofitting kit for retrofitting an existing troffer light fixture having a troffer housing, comprising:

at least one of an adapter bracket and a retainer configured to engage at least one of the existing troffer light fixture and a T-bar of a ceiling system; and a door assembly configured to be held in the ceiling system by the at least one of the adapter bracket and the retainer, the door assembly including:

a housing including one or more sidewalls, wherein the one or more sidewalls extend upward to define a cavity; and a plurality of LEDs having primary light axes extending inward into the cavity, the plurality of LEDs coupled to the one or more sidewalls and positioned to illuminate at least a portion of the housing from behind with a uniform distribution of light when engaged, wherein the plurality of LEDs are disposed around at least a portion of a periphery of the housing thereby providing a low-profile lighting arrangement configured to fit within a space above the ceiling system.

2. The retrofitting kit of claim 1, wherein the one or more sidewalls extend in a generally vertical direction, wherein the plurality of LEDs are positioned such that the primary light axes thereof extend generally orthogonal to the one or more sidewalls such that light emitted by the plurality of LEDs is reflected by at least one of the housing and a reflector.

3. The retrofitting kit of claim 2, wherein the retainer is defined by a portion of the housing, wherein the housing has a width that is larger than the width of an opening defined by T-bars of the ceiling system such that engagement between the housing and the T-bars of the ceiling system holds the door assembly in place.

4. The retrofitting kit of claim 3, further comprising an enclosure configured to contain electronics therein, wherein the enclosure is disposed within the cavity thereby reducing the height of the door assembly.

5. The retrofitting kit of claim 4, wherein the housing of the door assembly includes a top panel that defines a portion of the cavity.

6. The retrofitting kit of claim 3, further comprising a lens including an arcuate portion coupled to the housing with one or more supports, wherein the lens is inset into the cavity.

7. The retrofitting kit of claim 1, wherein the plurality of LEDs are positioned such that the primary light axes thereof are directed toward at least one of the housing and a reflector.

8. The retrofitting kit of claim 1, wherein the primary light axes of the plurality of LEDs are directed inward thereby exposing at least a portion of the housing to a uniform distribution of light.

9. The retrofitting kit of claim 1, wherein the housing comprises four sidewalls positioned in a rectangular arrangement, wherein the plurality of LEDs are coupled to each of the four sidewalls.

10. The retrofitting kit of claim 1, wherein the plurality of LEDs are positioned in a linear array.

11. A light fixture, comprising:

a retainer configured to engage a T-bar of a ceiling system; and a door assembly configured to be held in the ceiling system by the retainer, the door assembly including:

a housing including one or more sidewalls, wherein the one or more sidewalls extend upward to define a cavity; and a plurality of LEDs having primary light axes extending inward into the cavity, the plurality of LEDs coupled to the one or more sidewalls and positioned to illuminate at least a portion of the housing from behind with a uniform distribution of light when engaged, wherein the plurality of LEDs are disposed around at least a portion of a periphery of the housing thereby providing a low-profile lighting arrangement configured to fit within a space above the ceiling system.

12. The light fixture of claim 11, wherein the one or more sidewalls extend in a generally vertical direction, wherein the plurality of LEDs are positioned such that the primary light axes thereof extend generally orthogonal to the one or more sidewalls such that light emitted by the plurality of LEDs is reflected by at least one of the housing and a reflector.

13. The light fixture of claim 12, wherein the retainer is defined by a portion of the housing, wherein the housing has a width that is larger than the width of an opening defined by T-bars of the ceiling system such that engagement between the housing and the T-bars of the ceiling system holds the door assembly in place.

14. The light fixture of claim 13, further comprising an enclosure configured to contain electronics therein, wherein the enclosure is disposed within the cavity thereby reducing the height of the door assembly.

15. The light fixture of claim 14, wherein the housing of the door assembly includes a top panel that defines a portion of the cavity.

16. The light fixture of claim 13, further comprising a lens including an arcuate portion coupled to the housing with one or more supports, wherein the lens is inset into the cavity.

17. The light fixture of claim 11, wherein the plurality of LEDs are positioned such that the primary light axes thereof are directed toward at least one of the housing and a reflector.

18. The light fixture of claim 11, wherein the primary light axes of the plurality of LEDs are directed inward thereby exposing at least a portion of the housing to a uniform distribution of light.

19. The light fixture of claim 11, wherein the housing comprises four sidewalls positioned in a rectangular arrangement, wherein the plurality of LEDs are coupled to each of the four sidewalls.

20. A method for retrofitting an existing troffer light fixture using a door assembly, comprising:

removing a door of the existing troffer light fixture;

disconnecting wiring from a power source to the existing troffer light fixture;

wiring the door assembly to the wiring from the power source; and installing the door assembly within a ceiling system with which the existing troffer light fixture is associated, wherein installing the door assembly includes inserting a housing of the door assembly through an opening in the ceiling system and thereafter lowering the housing such that a portion of the door assembly engages a T-bar of the ceiling system, wherein the door assembly includes a plurality of LEDs coupled to one or more sidewalls of the housing.

* * * * *